US009289824B2

(12) United States Patent
Banno et al.

(10) Patent No.: US 9,289,824 B2
(45) Date of Patent: Mar. 22, 2016

(54) POURING EQUIPMENT AND METHOD OF POURING USING THE POURING EQUIPMENT

(75) Inventors: Kouichi Banno, Nagoya (JP); Toshiyuki Hyoudo, Nagoya (JP); Tadashi Nishida, Nagoya (JP); Hideto Terada, Nagoya (JP)

(73) Assignees: SINTOKOGIO, LTD., Nagoya-Shi (JP); FUJIWA DENKI CO., LTD., Nagoya-Shi (JP)

( * ) Notice: Subject to any disclaimer, the term of this patent is extended or adjusted under 35 U.S.C. 154(b) by 150 days.

(21) Appl. No.: 13/636,420

(22) PCT Filed: Jun. 29, 2011

(86) PCT No.: PCT/JP2011/003712

§ 371 (c)(1), (2), (4) Date: Sep. 21, 2012

(87) PCT Pub. No.: WO2012/026060

PCT Pub. Date: Mar. 1, 2012

(65) Prior Publication Data

US 2013/0140335 A1 Jun. 6, 2013

(30) Foreign Application Priority Data

Aug. 26, 2010 (JP) ..... 2010-189024
Dec. 2, 2010 (JP) ..... 2010-269587

(51) Int. Cl.
*B22D 39/04* (2006.01)
*B22D 37/00* (2006.01)

(52) U.S. Cl.
CPC ..... *B22D 39/04* (2013.01); *B22D 37/00* (2013.01)

(58) Field of Classification Search
CPC ..... B22D 17/32; B22D 39/04; B22D 17/30; B22D 37/00; B22D 41/00; B22D 41/12; B22D 41/18; B22D 41/04; B22D 11/10; B22D 5/00; B22D 7/00
USPC ..... 222/604, 590, 57, 58; 164/135, 136, 164/155.1, 155.2, 155.7, 457, 335–337, 164/453, 4.1; 266/236
See application file for complete search history.

(56) References Cited

U.S. PATENT DOCUMENTS 3,818,971 A * 6/1974 Schutz ..... 164/457
3,834,587 A * 9/1974 Bengt et al. ..... 222/595
(Continued)

FOREIGN PATENT DOCUMENTS

CN 101454100 6/2009
EP 2140955 * 1/2010 ..... B22D 39/04
(Continued)

OTHER PUBLICATIONS

International Search Report dated Oct. 25, 2011; Application No. PCT/JP2011/003712; 2 pages.

*Primary Examiner* — Scott Kastler
*Assistant Examiner* — Michael Aboagye
(74) *Attorney, Agent, or Firm* — Finnegan, Henderson, Farabow, Garrett & Dunner, L.L.P.

(57) ABSTRACT

The present invention provides pouring equipment of a tilting-type that can appropriately pour molten metal at a high speed corresponding to the speed of molding. It also provides a method of pouring the molten metal. The pouring equipment has a holding furnace supplying the molten metal by being tilted, a pouring ladle pouring the molten metal supplied from the holding furnace into molds that are intermittently transported, a device for measuring weight of the molten metal in the pouring ladle, and equipment for control that controls the tiltings of the holding furnace and the pouring ladle. The equipment for control has a device for storing results from measurements and devices for calculating the first and second flow rate. The equipment controls the tilting of the ladle so that the ladle pours the molten metal into the mold according to the flow pattern of the product.

22 Claims, 11 Drawing Sheets

(56) References Cited

U.S. PATENT DOCUMENTS

| | | | | |
|---|---|---|---|---|
| 3,876,109 | A | 4/1975 | Kreuz | |
| 4,084,631 | A * | 4/1978 | Kunzmann | 164/457 |
| 4,470,445 | A * | 9/1984 | Mangan et al. | 164/155.7 |
| 4,745,620 | A * | 5/1988 | Mortimer | 373/152 |

FOREIGN PATENT DOCUMENTS

| | | |
|---|---|---|
| JP | 07-214293 | 8/1995 |
| JP | 9-164473 | 6/1997 |
| JP | 2001-321924 | 11/2001 |
| WO | WO 2010/113676 A1 | 10/2010 |

* cited by examiner

POURING EQUIPMENT AND METHOD OF POURING USING THE POURING EQUIPMENT

TECHNICAL FIELD

This invention is related to pouring equipment that pours molten metal into a mold that is transported and it is also related to a method of pouring the molten metal.

BACKGROUND OF ART

Conventionally, a high-speed molding line such as the vertical flaskless molding line described in Patent Document 1 is required to pour molten metal at high speed. One example of the pouring equipment that is suitable for high-speed pouring is stopper-type pouring equipment. For example, the stopper-type pouring equipment disclosed in Patent Document 2 opens and closes a nozzle for pouring provided at the bottom of a ladle by a stopper (stopper rod). The molten metal is held and stored in the ladle when the nozzle for pouring is closed by the stopper. The molten metal is poured from the ladle into a sprue of a mold that is placed below the nozzle when the nozzle for pouring is opened by the stopper.

But the stopper type pouring equipment has problems in that often an impure substance adheres to the stopper or a bleeder occurs because of the wear of the stopper. Further, time and money must be taken to maintain the equipment so as to repair or replace the stopper. One method to avoid these problems is that pouring equipment of a type other than the stopper-type can be used. For example, tilting-type automatic pouring equipment that pours molten metal into a mold by tilting a ladle can be used. However, the pouring equipment that adopts the conventional tilting method cannot pour the molten metal at high speed. Further, the tilting type automatic pouring equipment should also achieve an appropriate pouring while it pours the molten metal at high speed.

RELATED ART DOCUMENTS

Patent Documents

Patent Document 1: Publication of Patent Application, Publication number H9-164473

Patent Document 2: Publication of Patent Application, Publication number H7-214293

SUMMARY OF INVENTION

Technical Problem

The present invention is to provide pouring equipment of a tilting-type that can appropriately pour molten metal at a high speed corresponding to the speed of molding even if the molding is made at a high speed. It also provides a method of pouring the molten metal.

Means to Solve the Problems

The pouring equipment of the present invention that controls the tilting of a pouring ladle comprises the following:

a holding furnace that stores and holds molten metal and that supplies it by being tilted;

a pouring ladle that stores the molten metal that is supplied from the holding furnace, and that pours the molten metal, by being tilted, into molds that are intermittently transported;

a device for (*) measuring weight, which device measures the weight of the molten metal in the pouring ladle; and equipment for control that controls the tilting movements of the holding furnace and the pouring ladle, wherein the equipment for control comprises:

a device for storing results from measurements, the measurements made by the device for measuring weight;

a device for calculating the first flow rate, which device calculates the flow of the molten metal that is supplied from the holding furnace to the pouring ladle based on the results of the measurements obtained when the molten metal is not poured by the pouring ladle, and which results are stored in the device for storing results from measurements;

a device for calculating the second flow rate, which device calculates the flow of the molten metal that is supplied from the pouring ladle to the mold based on the results of the measurements obtained when the molten metal is poured by the pouring ladle, and which results are stored in the device for storing results from measurements, wherein the equipment for control controls the tilting of the ladle so as to have the pouring ladle pour the molten metal into the mold according to the flow pattern specific to each product, based on the information on the flow of the molten metal that is poured into the mold, which information is calculated by and obtained from the device for calculating the second flow rate.

(*) The term "device for" used in the specification, etc., of the application can be replaced by the term "means for," depending on the context.

A method of the present invention pours the molten metal into the mold using the pouring equipment that comprises the following:

a holding furnace that stores and holds molten metal and that supplies it by being tilted;

a ladle that stores the molten metal that is supplied from the holding furnace and that pours the molten metal, by being tilted, into molds that are intermittently transported;

a device for measuring weight, which device measures the weight of the molten metal in the pouring ladle; and equipment for control that controls the tilting movements of the holding furnace and the pouring ladle, wherein the equipment for control comprises the following:

a device for storing results from measurements, the measurements made by the device for measuring results;

a device for calculating the first flow rate, which device calculates the flow of the molten metal that is supplied from the holding furnace to the pouring ladle based on the results of measurements obtained when the molten metal is not poured by the ladle, and which results are stored in the device for storing results from measurements;

a device for calculating the second flow rate, which device calculates the flow of the molten metal that is supplied from the ladle to the mold based on the results of the measurements obtained when the molten metal is poured by the ladle, and which results are stored in the device for storing results from measurements, wherein the equipment for control controls the tilting of the pouring ladle so as to have the pouring ladle pour the molten metal into the mold according to the flow pattern specific to each product, based on the information on the flow of the molten metal that is poured, which information is calculated by and obtained from the device for calculating the second flow rate.

Effect of the Invention

The present invention is to provide pouring equipment of a tilting-type that can appropriately pour molten metal at a high speed corresponding to the speed of molding even if the molding is made at a high speed, whereby it prevents a bleeder from occurring and saves the time and money that would be taken to maintain the equipment.

BRIEF DESCRIPTION OF DRAWINGS

FIG. 8 (A) shows a pattern where the flow is nearly constant.

FIG. 8 (B) shows a pattern where the flow of molten metal is less in the first half of the period and larger in the second half of the period.

FIG. 8 (C) shows a pattern where the flow of molten metal is larger in the first half of the period and less in the second half of the period.

FIG. 12 (*a*) shows a standard position where the holding furnace in a position for supplying the molten metal (hereafter, the position for supplying) pours the metal into the pouring ladle and at the same time the pouring ladle pours the molten metal into the mold.

FIG. 12 (*b*) shows the position where the pouring ladle pours the molten metal into the mold and the holding furnace that is transported to a standby position is in a position ready to replace the other holding furnace.

FIG. 12 (*c*) shows the position where the pouring ladle pours the metal into the mold and the holding furnace that is to be replaced is withdrawn from the position for supplying.

FIG. 12 (*d*) shows the position where the pouring ladle pours the molten metal into the mold and where the holding furnace that was standing by is moved to a position next to the position for supplying, while the holding furnace that is to be replaced and that was withdrawn from the position for supplying simultaneously.

FIG. 12 (*e*) shows the position where the pouring ladle pours the molten metal into the mold and where the holding furnace that was standing by and that is moved to the position next to the position for supplying is placed in the position for supplying.

FIG. 12 (*f*) shows the position where the holding furnace that was withdrawn from the position for supplying was transported toward a melting furnace and where the conditions at the position for supplying returned to those of the standard position. Namely, the holding furnace that is placed in the position for supplying pours the molten metal into the pouring ladle and the pouring ladle pours the molten metal into the mold.

EMBODIMENTS TO CARRY OUT THE INVENTION

Figure 1:
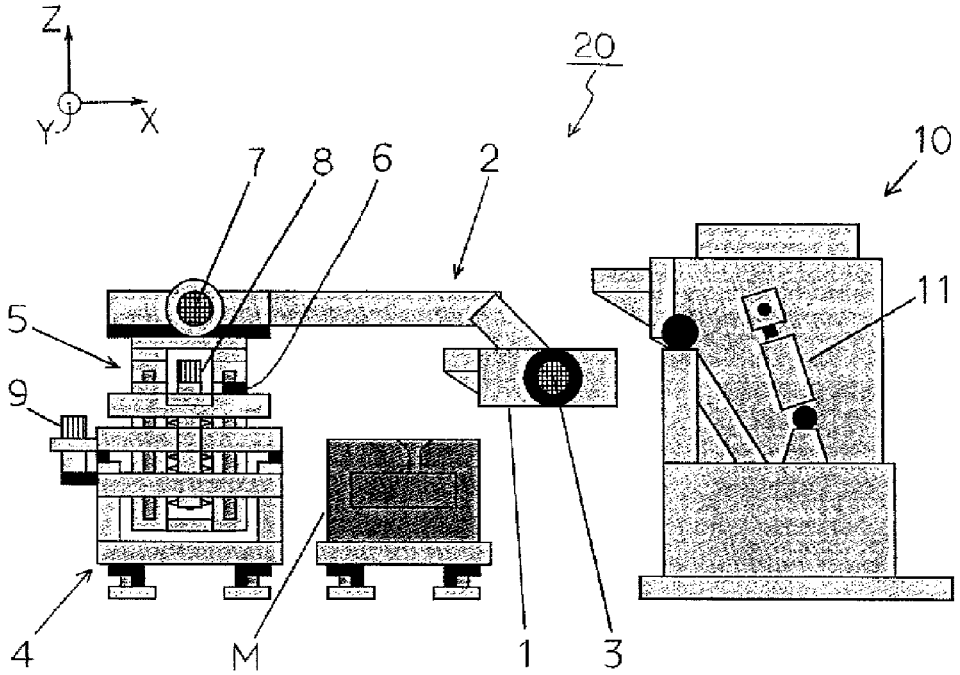
FIG. 1 is a front view of the pouring equipment in the first embodiment.

The pouring equipment of the present invention and the method of pouring using the pouring equipment are explained by referring to the drawings. First, a first embodiment of the pouring equipment 20 of the present invention is explained by referring to FIGS. 1 to 8. In the explanation below, the pouring equipment of this embodiment is explained based on automatic pouring equipment 20 that is used to pour molten metal into molds M that were molded, for example, with a vertical flaskless molding line (not shown).

As shown in FIGS. 1-4, the pouring equipment 20 comprises:

- a holding furnace 10 that stores and holds the molten metal and that pours it by being tilted;
- a pouring ladle 1 that stores the molten metal that is supplied from the holding furnace 10 and that pours the molten metal, by being tilted, into molds M that are intermittently transported; and
- a load cell 6 as a device for measuring weight, which device measures the weight of the molten metal in the pouring ladle 1.

In FIG. 1 the pouring ladle 1 is disposed at the position to the outside of one part of (the right-hand side of FIG. 1) and above, the mold M. The pouring ladle 1 can store an amount in weight of the molten metal that is equivalent to the molten metal that can be poured into a plurality of molds. A supporting arm 2 that extends horizontally is attached to one end of the pouring ladle 1. At the end of the supporting arm 2 is attached a mechanism to drive tilting 3 (for example, a motor) as a device for tilting the pouring ladle, which device tilts the pouring ladle 1.

Preferably the inner shape of the pouring ladle is formed in such a way that the horizontal cross section (i.e., the upper surface of the molten metal) of the pouring ladle is nearly constant regardless of the angle of the tilting of the ladle. Such a shape can include, for example, a shape of a fan, a rectangle, or a square on its longitudinal section.

A traversing frame 4 is disposed on the outside of the other part of the mold M. A lifting frame 5 is attached to the traversing frame 4 in such a way that the lifting frame 5 can go up and down. On the upper part of the lifting frame 5 is attached the supporting arm 2, which can move backward and forward. In the present invention to move "backward and forward" means a movement in the X-direction as given in FIG. 1.

The load cell 6 as a device for measuring weight, which device measures the weight of molten metal in the pouring ladle 1, is attached to the lifting frame 5. The device for measuring weight that constitutes the pouring equipment 20 is not limited to a load cell, but other measuring units can be used. The weight of the molten metal in the pouring ladle can be obtained by subtracting the tare weight that was measured in advance from the weight measured with the load cell 6.

Further, a mechanism to drive in the X-direction 7 (for example, a motor) that drives the pouring ladle in the X-direction is attached to the lifting frame 5. As shown in FIG. 1, the X-direction is perpendicular to a Y-direction. The Y-direction is the one in which the molds M move. The pouring ladle 1, together with the supporting arm, can be moved in the X-direction with the mechanism to drive in the X-direction.

Further, a mechanism to drive in the Z-direction 8 (for example, a motor) that moves up and down the pouring ladle 1 in the Z-direction is attached to the lifting frame 5. As seen from FIG. 1, the Z-direction is the one that forms right angles with the X-direction and Y-direction, i.e., the up-and-down direction. The pouring ladle 1 can move up and down, together with the lifting frame 5 and the supporting arm 2, by the mechanism to drive in the Z-direction 8.

A mechanism to drive the pouring ladle 1 in the Y-direction 9 (for example, a motor) is attached to the traversing frame 4. The pouring ladle 1 can move up and down, together with the lifting frame 5 and the supporting arm 2, by the mechanism to drive the pouring ladle in the Y-direction 9 (the direction of the movement of mold M and its reverse direction).

The holding furnace 10 is disposed to the outside of one part of the pouring ladle 1. It stores the molten metal and pours it into the pouring ladle 1.

A cylinder for tilting 11 is attached to the holding furnace 10 as a device to drive the tilting of the holding furnace. The cylinder for tilting 11, as the device for tilting the holding furnace 10, tilts the holding furnace 10 in the forward direction in the same condition (basically the speed of the tilting is constant) such that the molten metal that is poured from the holding furnace 10 into the pouring ladle 1 is kept constant. That is, the tilting of the holding furnace is controlled in such a way that the flow of molten metal (flow per unit of time) is constant whether or not the pouring ladle 1 pours the molten metal into the mold. More particularly, the data on the tilting of the holding furnace 10 are previously stored, such that the flow of molten metal is kept constant. In this embodiment, the pouring equipment uses a cylinder-type device for tilting the holding furnace. However, the pouring equipment can use a gear-type device for tilting the holding furnace, such as a sector gear having a semicircular shape. Also, the holding furnace can move in the X-direction with a mechanism to drive the holding furnace in the X-direction (not shown). It can be also moved in the Y-direction by the mechanism to drive the holding furnace in the Y-direction.

The pouring equipment 20 comprises the equipment for control 30. The equipment for control 30 that controls the movements of the tilting of the holding furnace 10 and the pouring ladle 1, based on the information obtained from the results of measurements by the load cell, or the like, which is a device for measuring weight. The equipment for control 30 comprises a processing unit for control comprising an input unit, a processing and calculating unit, a memory unit, a display unit, an output unit, a storage unit, etc. This processing unit for control reads out the programs stored in the storage unit into the memory unit and processes the data by the processing and calculating unit that works as a determining unit, calculating unit, integrating unit and a controlling unit, in a way that is explained below based on FIGS. 5-7.

Figure 5:
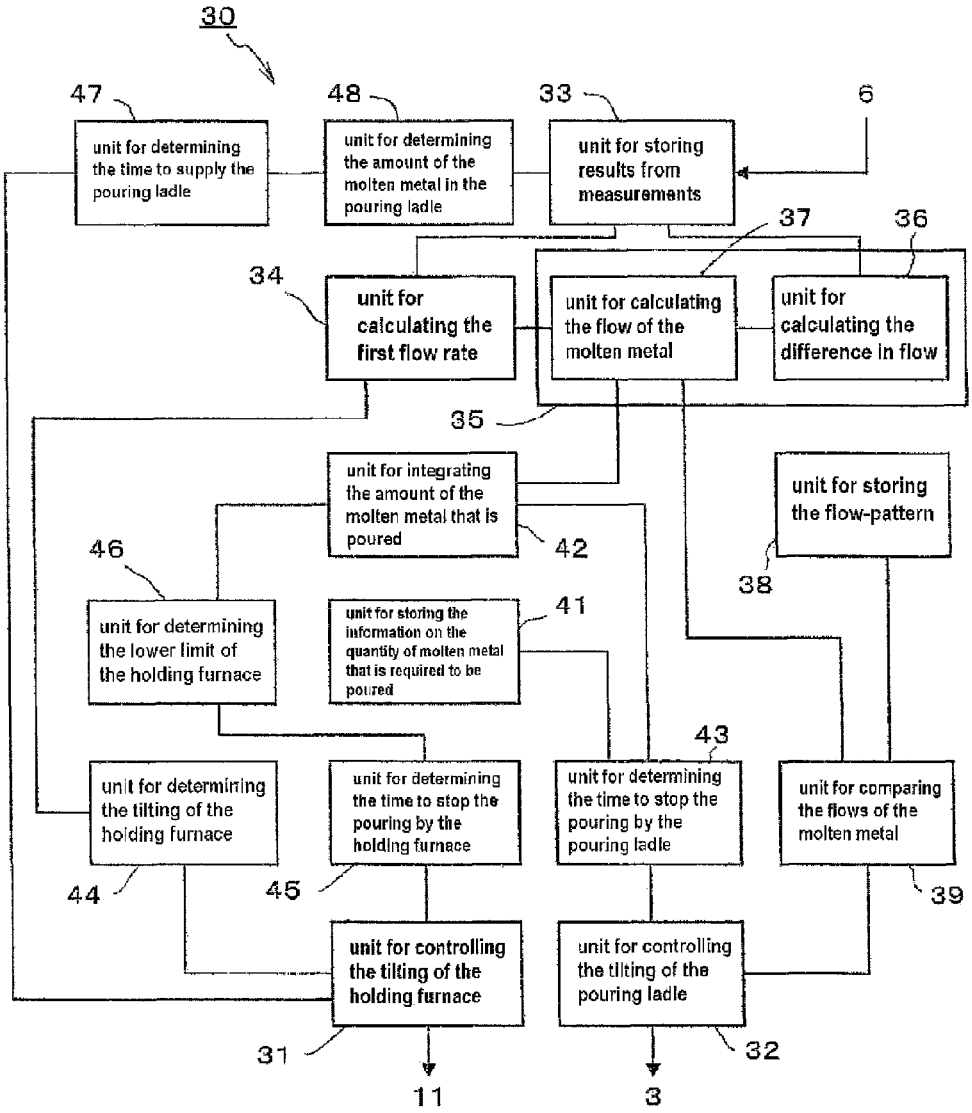
FIG. 5 is a schematic diagram of the equipment for control that constitutes the pouring equipment.

That is, as shown in FIG. 5, the equipment for control 30 comprises a unit for controlling the tilting of the holding furnace 31 and a unit for controlling the tilting of the pouring ladle 32. The unit for controlling the tilting of the holding furnace 31 controls the cylinder for tilting 11, which is a device for driving the tilting of the holding furnace. The unit for controlling the tilting of the pouring ladle 32 controls the mechanism to drive the tilting of the pouring ladle 3, which is a device for driving the tilting of the pouring ladle.

The equipment for control 30 comprises a unit for storing results from measurements 33 and a unit for calculating the first flow 34. Also, the equipment for control 30 comprises a unit for calculating the difference in flow 36 and a unit for calculating the of flows of the molten metal 37 as a unit for calculating the second flow 35.

The unit for storing results from measurements 33 periodically stores the results measured by the load cell 6 that are entered. The unit for calculating the first flow rate34 calculates the flow of molten metal that is supplied from the holding furnace 10 to the pouring ladle 1, Vin, based on the results that are stored in the unit for storing results from measurements 33 and that are obtained when the pouring ladle 1 does not pour the molten metal.

The unit for calculating the difference in flow 36 calculates the difference in flow between the flow of the molten metal that is supplied to the pouring ladle 1, Vin, and the flow of the molten metal that is poured from the pouring ladle 1 to the mold M, Vout, based on the results of measurements when the pouring ladle 1 pours the molten metal. This relationship is expressed by the following formula: Vx=Vin-Vout.

The unit for calculating the flow of the molten metal 37 calculates the flow of the molten metal that is poured from the pouring ladle 1 to the mold M, Vout, based on (1) the difference in the flow, Vx, that is calculated by the unit for calculating the difference in flow 36 and (2) the flow of the molten metal Vin that is calculated by the unit for calculating the first flow rate 34 and that is supplied to the pouring ladle 1.

In this way the device for calculating the second flow rate 35 consisting of the unit for calculating the difference in flow 36 and the unit for calculating the flow of the molten metal 37 calculates the flow of the molten metal, Vout, that is poured from the pouring ladle 1 to the mold M, based on the results of the measurements that are stored in the unit for storing results from measurements 33 and that are obtained when the pouring ladle 1 pours the molten metal.

Also, the equipment for control 30 comprises a unit for storing the flow pattern 38, which is a device for storing the flow-pattern, and a unit for comparing the flows of the metal that is poured 39, which is a device for monitoring the flow of the molten metal.

The unit for storing the flow-pattern 38 stores the data on the flow-pattern of the molten metal that is poured. The flow-patterns correspond to those of the respective molds that are transported at intervals. The flow-patterns, which are stored in the computer that controls the entire facility, including the pouring equipment 20, and which are stored in the storage medium that is computer-readable, are entered into the unit for storing the flow-pattern 38 corresponding to those of the respective molds that are transported. The unit for controlling the tilting of the pouring ladle 32 controls the tilting of the pouring ladle 1 by such an angle that the molten metal is poured in accordance with the flow patterns that are varied in correspondence with the time that has elapsed.

The unit for comparing the flows of the metal 39 monitors at predetermined intervals the flow of the molten metal to see if the flow of the molten metal that is expected on the predetermined flow-pattern and the flow of the molten metal that is calculated based on the information obtained from the load cell 6 are the same. The unit for comparing the flows of the molten metal that is poured 39 compares (1) the flow that is scheduled on the flow-pattern and that is stored in the unit for storing the flow-pattern 38 and that is considered to be an ideal flow-pattern to (2) the flow of the molten metal that is poured into the mold M and that is calculated by the unit for calculating the flow of the molten metal 37, Vout, based on the results of the measurements. Then if any difference occurs between these two flows, the unit for comparing the flows of the molten metal that is poured 39 feeds back the information on this difference to the unit for controlling the tilting of the pouring ladle 32.

The unit for controlling the tilting of the pouring ladle 32 that receives the information on the difference controls the angle of tilting the pouring ladle so as to compensate for this difference. In this way the equipment for control 30 controls the pouring ladle 1, based on the information that is calculated by the device for calculating the second flow rate 35, so that the pouring ladle 1 can pour the molten metal in accordance with the flow-pattern that corresponds to the kind of product that is manufactured.

Further, the equipment for control 30 comprises a unit for storing the information on the quantity of the molten metal that is required to be poured 41, a unit (device) for integrating the amount of the molten metal that is poured 42, and a unit for determining the time to stop the pouring by the pouring ladle 43.

The unit for storing the information on the quantity of the molten metal that is required to be poured 41 stores the information on the molten metal required for each of the molds that are transported at intervals. The information on the quantity of the molten metal required for each of the molds is entered into the unit for storing the information on the quantity of molten metal that is required to be poured 41 based on the flow-pattern. It is entered by the computer, etc., that control all the facilities. The unit for integrating the amount of molten metal that is poured 42 calculates by accumulation the quantity of the molten metal required for the mold, based on the flow of the molten metal that is calculated in the unit for calculating the flow of the molten metal 37.

The unit for determining the time to stop the pouring by the pouring ladle 43 determines if the pouring ladle should stop pouring the molten metal, based on the comparison between the quantity of molten metal that is required to be poured and that is stored in the unit for storing the information on the quantity of molten metal that is required to be poured 41 and the quantity of the molten metal that is poured and that is calculated in the unit for integrating the amount of the molten metal that is poured 42. More particularly, when the quantity of molten metal that was poured and that is calculated by the process of integration reaches the level where the quantity of molten metal that was poured is less than the quantity of molten metal that is required to be poured by the predetermined quantity, the unit for determining the time to stop the pouring by the pouring ladle 43 determines to start the movement to stop the pouring.

Upon receiving the information the unit for controlling the tilting of the pouring ladle 32 has the pouring ladle tilt backward to the horizontal position. In this way the equipment for control 30 has the pouring ladle 1 stop pouring by tilting the pouring ladle, if the unit for determining the time to stop the pouring by the pouring ladle 43 determines that it is the time to stop the pouring by the pouring ladle 1.

Further, the equipment for control 30 comprises a unit for determining the tilting of the holding furnace 44 as a device for monitoring the tilting of the holding furnace 44, a unit for determining the time to stop the pouring by the holding furnace 45 as a device for determining the time to stop the pouring of the holding furnace 45, a unit for determining the lower limit of the holding furnace 46 as a device for determining the lower limit of the holding furnace, a unit for determining the time to supply the pouring ladle 47 as a device for determining the time to supply the pouring ladle, and a unit for determining the amount of the molten metal in the pouring ladle 48 as a device for determining the amount of the molten metal in the pouring ladle.

The unit for determining the tilting of the holding furnace 44 monitors the tilting of the holding furnace 10, based on the information on the data that were calculated by the unit for calculating the first flow rate 34 when the pouring ladle 1 does not pour the molten metal. The unit for determining the tilting of the holding furnace 44 controls the speed of the tilting of the holding furnace 10 so that the flow that is calculated by the unit for calculating the first flow rate 34 is within a certain range when the pouring ladle 1 does not pour the molten metal. The words "within a certain range" are used to allow a marginal error over the fixed constant flow. The holding furnace 10 is designed in such a way that the flow of the molten metal is constant if the speed of the tilting of the holding furnace 10 is constant. Thus the unit for controlling the tilting of the holding furnace 31 controls the tilting of the holding furnace so that the flow of the molten metal that is supplied from the holding furnace 10 into the pouring ladle 1 is constant based on the information from the unit for determining the tilting of the holding furnace 44 when the pouring ladle 1 does not pour the molten metal. Similarly the unit for controlling the tilting of the holding furnace 31 controls the tilting of the holding furnace so that the flow of the molten metal that is supplied from the holding furnace is constant when the pouring ladle 1 pours the molten metal under the same conditions. In this embodiment, the holding furnace is designed in such a way that the flow of the molten metal is constant if the speed of the tilting of the holding furnace 10 is constant. But the unit for determining the tilting of the holding furnace 44, by monitoring the relationship between the speed of the tilting and the flow of the molten metal, controls the tilting of the holding furnace so that the molten metal supplied from the holding furnace 10 is constant at all times.

The unit for determining the time to stop the pouring by the holding furnace 10 determines whether the holding furnace stops pouring. Further, the unit for integrating the amount of the molten metal that is poured 42 calculates the total molten metal that was poured from the holding furnace 10 into the molds through the pouring ladle 1. The unit for determining the lower limit of the holding furnace 46 determines whether the amount of the molten metal in the holding furnace 10 is less than its lower limit, based on the total amount of the molten metal that is poured and that was calculated from the unit for integrating the amount of the molten metal that is poured 42. That is, the capacity of the holding furnace 10 and the maximum storing capacity of the pouring ladle 1 are previously entered into the memory such that the balance above the lower limit can be worked out by subtracting the total amount of the molten metal supplied (the total amount of the molten metal that is poured plus the maximum storing capacity of the pouring ladle) from the capacity of the holding furnace. The unit for determining the time to stop the pouring by the holding furnace 45 determines that the pouring should be stopped if at least the unit for determining the lower limit of the holding furnace 46 determines that the amount of the molten metal in the holding furnace 10 is below the lower limit. Further, the unit for determining the time to stop the pouring by the holding furnace 45 determines that the pouring should be stopped when the entire facility is to stop the operation, when the molding line is stopped, when the material is to be changed, when the computer instructs it, or when the user instructs it. If the unit for determining the time to stop the pouring by the holding furnace 45 determines that it is the time to stop the pouring, the equipment for control 30 tilts the holding furnace 10 so that it stops the pouring.

The unit for determining the amount of the molten metal in the pouring ladle 48 determines whether the amount of the molten metal in the pouring ladle 1 is more or less than the predetermined level based on a signal received from the unit for storing results from measurements 33 that stores the information on the results from measurements made by the load cell. The words "predetermined level" refers to the level of the molten metal where the pouring from the holding furnace 10 into the pouring ladle 1 stops and where the amount of the molten metal in the ladle in weight can pour the molten metal for a plurality of the molds and also where in light of efficient pouring the amount is sufficient to fill most of the pouring ladle 1. In the following explanation the holding furnace starts pouring when the molten metal in the pouring ladle is below the predetermined level and stops pouring after the molten metal in the pouring ladle reaches above the predetermined level. The predetermined level at the start of the pouring is preferably fixed slightly lower than the predetermined level when the holding furnace stops pouring because the levels thus fixed allow smoother operation. But even if both the levels are fixed at the same level, it does not cause any problem. Also, the unit for determining the amount of the molten metal in the pouring ladle 48 has a function where it determines whether the amount of the molten metal in the pouring ladle 1, the data on which amount is stored in the unit for storing results from measurements 33, is larger than the amount of the molten metal that is stored in the unit for storing the information on the quantity of molten metal that is required to be poured 41 and that is required for the next mold to be poured. The unit for controlling the tilting of the pouring ladle 32 gives instructions to start pouring if the unit for determining the amount of the molten metal in the pouring ladle 48 determines that the amount of the molten metal in the pouring ladle 1 is larger than the amount to be poured into the next mold.

The unit for determining the time to supply the pouring ladle 47 instructs the unit for controlling the tilting of the holding furnace 31 to start tilting the holding furnace 10 and to start pouring from it the molten metal into the pouring ladle 1 if it determines, based on the signal from the unit for determining the amount of the molten metal in the pouring ladle 48, that the molten metal in the pouring ladle is below the predetermined level and if it determines there is not any other reason to deter the start of supplying the metal. The wording "any other reason to deter the start of supplying the metal" refers to, for example, the situations where all the facilities are about to stop operating, the molding line stops, or the change of the materials is about to take place.

Next, the movement of the pouring equipment 20 is explained. The pouring equipment 20 controls the tiltings of the holding furnace and the pouring ladle corresponding to the respective requirements. As the information for controlling the tilting, the results of the measurements obtained from the device for measuring weight (load cell 6), which are commonly used for the holding furnace and the pouring ladle, are used. Below the control of the tilting of the holding furnace is explained based on FIG. 6, and the control of the tilting of the pouring ladle is explained based on FIG. 7. Then the movements of the pouring equipment in general are explained.

Figure 6:
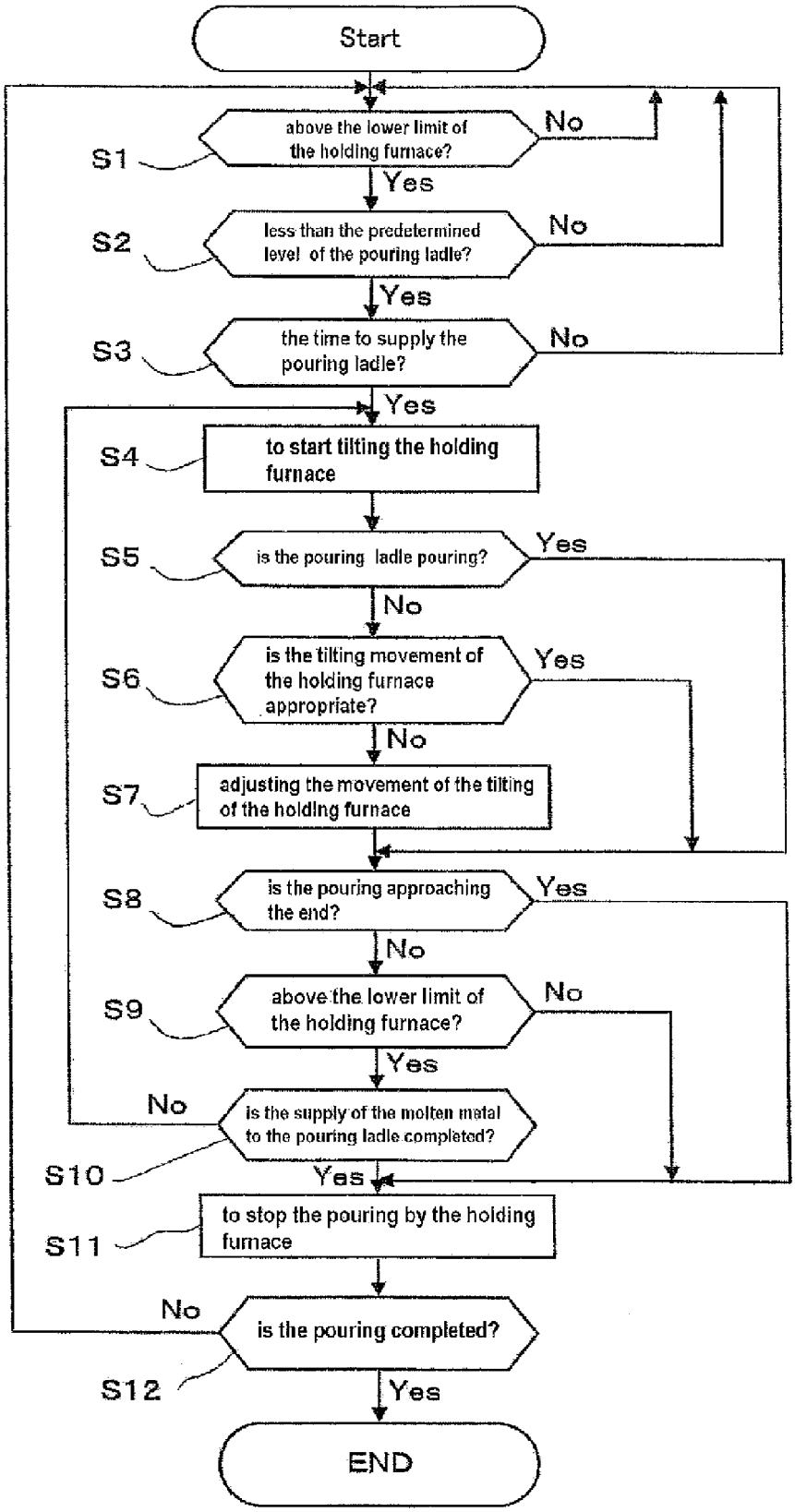
FIG. 6 is an illustration of a flow of molten metal poured from the holding furnace, of which the tilting is controlled.

As shown in FIG. 6, the process of tilting the holding furnace 10 of the pouring equipment 20 has steps S1 to S20. In step S1 the unit for determining the lower limit of the holding furnace 46 determines whether the level of the molten metal in the holding furnace 10 is above its lower limit. If it determines that the level of the molten metal is above the lower limit, the process moves to step S2. If the level of the molten metal is below the lower limit, the process returns to a start. In step S2 the unit for determining the amount of the molten metal in the pouring ladle 48 determines whether the pouring ladle 1 has the molten metal above the predetermined level. If the level of the molten metal is below the predetermined level, the process moves to step S3. If the level of the molten metal is above the predetermined level, the process returns to the start. In step S3 the unit for determining the time to supply the pouring ladle 47 determines whether the molten metal is to be supplied to the pouring ladle 1. If it is, then the process moves to step S4. If not, it returns to the start.

In step S4, based on the signal from the unit for determining the tilting of the holding furnace 44, the unit for controlling the tilting of the holding furnace 31 controls the cylinder for tilting 11, which is a device for driving the tilting of the holding furnace and have the holding furnace supply the molten metal into the pouring ladle 1 by tilting the holding furnace 10. In step 5 the equipment for control 30 determines whether the pouring ladle 1 is pouring the molten metal into the mold based on the signal from the unit for controlling the tilting of the pouring ladle 32. If it is pouring, the process moves to step S8. If not, it moves to step S6.

In step S6, the unit for determining the tilting of the holding furnace 44 determines whether the tilting movement of the holding furnace 10 is appropriate, namely, whether the tilting speed of the holding furnace 10 is in such a way that the flow of the molten metal is constant (for example, the tilting speed of the holding furnace is constant). If the tilting movement of is appropriate, the process moves to step S8. If it is not, the process moves to step S7. In step S7, the unit for controlling the tilting of the holding furnace 31 adjusts the tilting so that the tilting movement becomes constant.

In step S8 the equipment for control 30 determines whether the pouring approaches the end. If it determines that it does, the process moves to step 11. If it determines it does not, the process moves to step S9. In step S9 the unit for determining the lower limit of the holding furnace 46 determines whether the level of the molten metal in the holding furnace 10 is above its lower limit. If it determines that it is, the process moves to step S10. If the level of the molten metal is below the lower limit, the process moves to step S11.

In step S10, the unit for determining the amount of the molten metal in the pouring ladle 48 determines whether the supply of the molten metal to the pouring ladle is completed, depending on whether the level of the molten metal in the pouring ladle is above the predetermined level. If the molten metal is above the predetermined level, the supply to the pouring ladle is determined to have been completed and the process moves to step S11. If the molten metal is below the predetermined level, the supply to the pouring ladle is determined not to have been completed. Then the process moves to step S4 and the steps S4 to S10 are repeated.

In step S11 the unit for controlling the tilting of the holding furnace 31 controls and makes the cylinder for tilting 11 stop pouring based on the signal from the unit for determining the time to stop the pouring by the holding furnace 45. In step S12 the equipment for control 30 determines if the pouring should be completed. If it determines that it should not, then the process returns to step S1.

Figure 7:
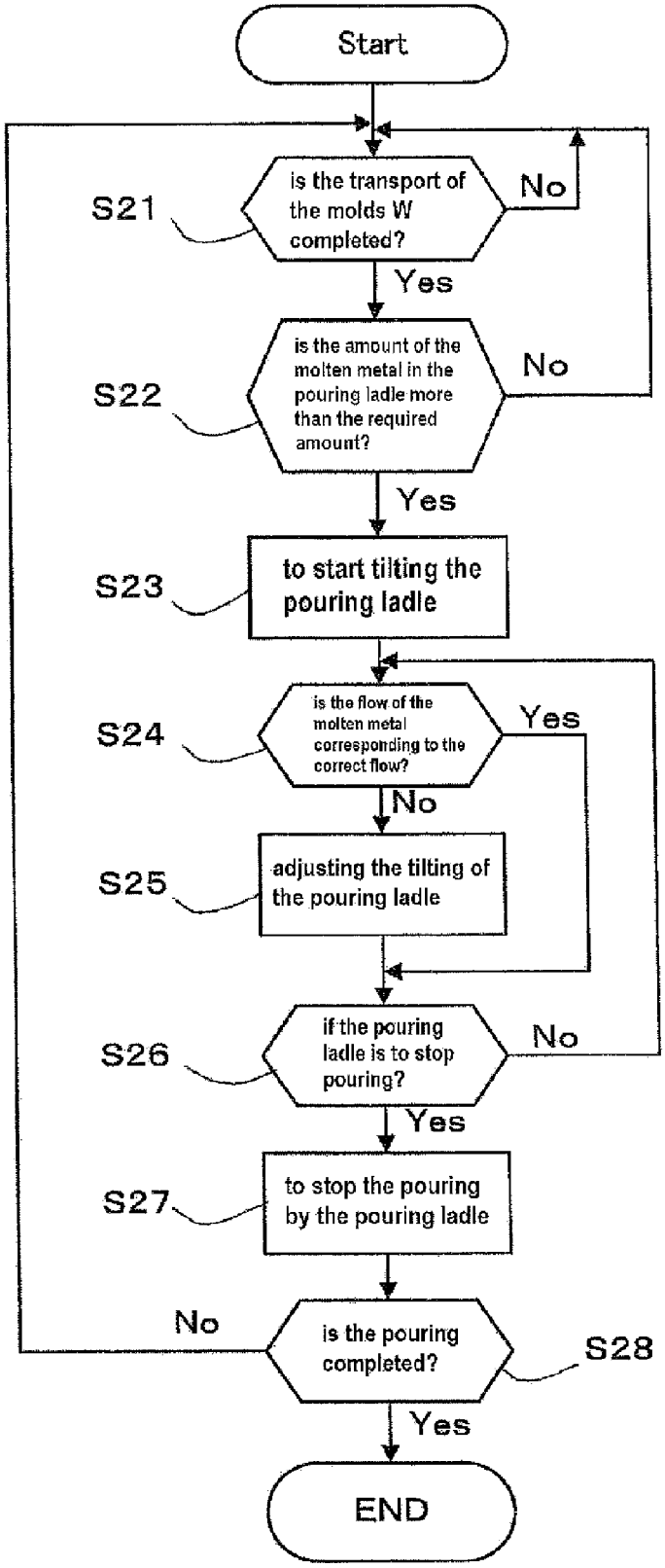
FIG. 7 is an illustration of a flow of molten metal poured from the pouring ladle, of which the tilting is controlled.

Next, the control of tilting the pouring ladle 1 is explained based on FIG. 7. As shown in FIG. 7, the process of tilting the pouring ladle 1 of the pouring equipment 20 has steps S21 to S27. In step S21 the equipment for control 30 determines whether the transport of the mold W that is to be poured by the pouring ladle 1 to the position of pouring has been completed. The information on this transport of the mold W is transmitted from the computer that controls all the facilities to the equipment for control 30. If the transport has not been completed, the process returns to the start. If it is completed, the process moves to step S22.

In step S22 the unit for determining the amount of the molten metal in the pouring ladle 48 determines whether the amount of the molten metal in the pouring ladle 1 is more than the amount of the molten metal that is required to be poured into the molds W, and the information on which amount is stored in the unit for storing the information on the quantity of molten metal that is to be poured 41. If the amount of the molten metal in the pouring ladle is more than the amount of the molten metal that is required to be poured into the mold W, the process moves to step S23. If it is less than the amount of the molten metal that is to be poured into the mold W, the process returns to the start.

In step S23 the unit for controlling the tilting of the pouring ladle 32 starts tilting the pouring ladle 1 by the mechanism to drive tilting 3. Then the process moves to step S24. In step S24 the unit for comparing the flows of the metal that is poured 39 determines whether the flow of the metal that is poured, which flow is based on the signal from the unit for calculating the flow of the molten metal 37, corresponds to the correct flow that is based on the flow pattern stored in the unit for storing the flow-pattern 38. If the flow of the metal that is poured corresponds to the correct flow, the process moves to step S26. If it does not, the process moves to step S25.

In step S25 the unit for controlling the tilting of the pouring ladle 32 adjusts the tilting of the pouring ladle 1 so that there is not any difference between the flow of the metal that is poured, which flow was calculated by the unit for calculating the flow of the molten metal 37, and the flow pattern. Then the process moves to step S26. In step S26, as stated above the unit for determining the time to stop the pouring by the pouring ladle 43 determines, based on the information from the unit for storing the information on the quantity of molten metal that is required to be poured 41 and the unit for integrating the amount of the molten metal that is poured 42, whether the pouring ladle 1 is to stop pouring. If it determines that the pouring ladle 1 is to stop pouring, the process moves to step S27. If it is determined that the pouring ladle 1 is not to stop pouring, the process moves to step 24 and then steps S24, S25, and S26 are repeated.

In step S27 the unit for controlling the tilting of the pouring ladle 32 controls the mechanism to drive tilting 3 and has it stop pouring. In step 28 the unit for controlling the tilting of the pouring ladle 32 determines whether to stop pouring. If it determines that the pouring ladle 1 should not stop pouring, then the process returns to step S21.

Next the movement of the pouring equipment 20 in general is explained. In preparing for pouring, the molten metal is poured from the holding furnace 10 into the pouring ladle 1 that is maintained in a horizontal position. Then the amount of the molten metal that can be poured into a plurality of the molds is stored in the pouring ladle 1. In pouring the molten metal into the ladle, the holding furnace 10 supplies the molten metal to the pouring ladle 1 by the movement of the extension of the cylinder for tilting 11, which movement tilts the holding furnace 10 forward. When the weight of the molten metal in the pouring ladle 1 reaches the predetermined level, the pouring of the molten metal into the pouring ladle 1 is stopped by having the holding furnace tilt backward by the contraction of the cylinder for tilting 11.

Figure 2:
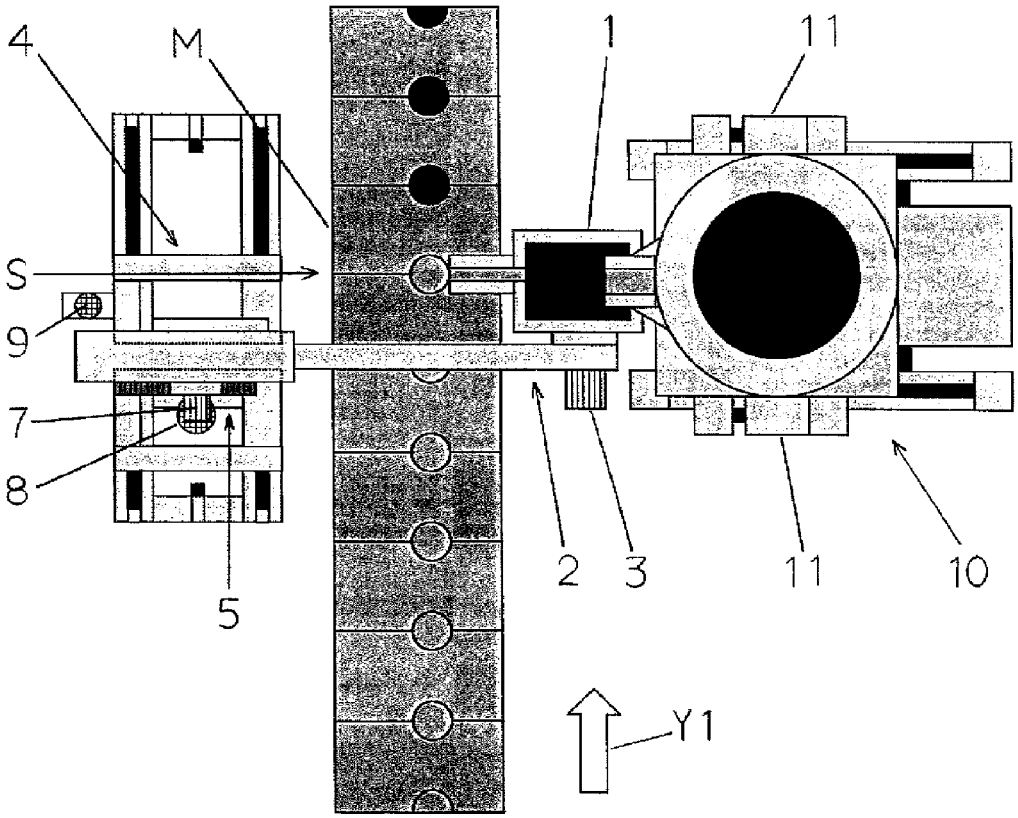
FIG. 2 is a plan view of the pouring equipment.
Figure 3:
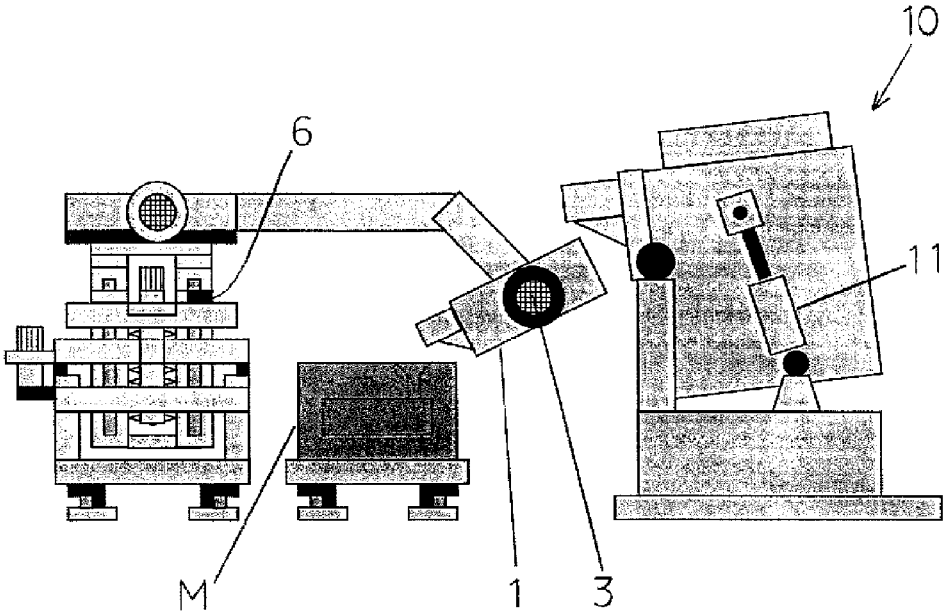
FIG. 3 is a front view of the pouring equipment where the pouring ladle pours the molten metal into the mold at the time that the molten metal is supplied by the holding furnace into the pouring ladle.
Figure 4:
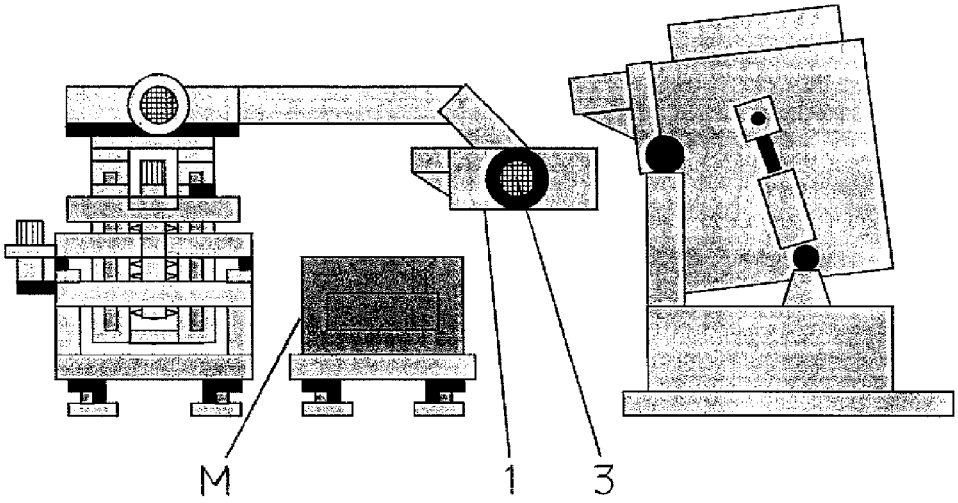
FIG. 4 is a front view of the pouring equipment where the pouring ladle stops supplying the molten metal into the mold.

Next the transport line for molds (not shown) intermittently transports a group of molds M manufactured by a vertical flaskless molding machine by one pitch (a distance that is equivalent to the movement of one mold) at a time and in the direction of the forward movement of the molds (the direction of arrow in FIG. 2). In this way the molds M that are to be poured are transported to the pouring station (see FIG. 2).

The thicknesses of the molds M that are produced by the vertical flaskless molding machine are varied and none is usually the same. So, the centers of the sprues in the direction of the forward movements of the molds M do not stop at the same position in the pouring station S. Therefore the centers of the sprues in the direction of the forward movements of the molds M that stop at the pouring station S are calculated from the data on the thicknesses of the molds, which data were obtained from the vertical flaskless molding machine. Then, the pouring ladle 1 is moved by the mechanism to drive in the Y-direction 9 in such a way that the center of the outflow position of the pouring ladle lin the direction of the forward movements of the molds M and the center of the sprue approximately coincide with each other in the Y-direction.

Next the pouring ladle 1 is tilted by having the mechanism to drive tilting 3 tilt forward and the molten metal in the pouring ladle 1 is poured into the molds at the pouring station S. The flow of the pouring ladle 1 is controlled, such that the pouring of the molten metal starts by the forward tilting of the pouring ladle 1. Also, during the pouring the adjustment of the tilting of the angle is made by the forward, backward tilting or the stop of the tilting of the pouring ladle 1 (also referred to as "tilting movements") and also the tilting speeds are varied based on the deviations of flows. Then the molten metal in the holding furnace 10 is supplied into the pouring ladle 1 by the holding furnace being tilted forward by the extension of the cylinder for tilting 11 while the pouring ladle 1 pours the molten metal into the molds M (see FIG. 3). The holding furnace 10 is controlled so that the flow of the molten metal that is supplied to the pouring ladle 1 is constant. Thus the holding furnace 10 is controlled so that it is tilted forward when it supplies the molten metal. Also, the holding furnace is controlled so that it stops tilting when it stops supplying the molten metal. Throughout the operation, the load cell 6 measures the weight of the molten metal in the pouring ladle 1 at predetermined intervals (for example, at every 0.01 second). As described above, the equipment for control 30 calculates, based on the weight of the molten metal thus measured, the difference in the flows between the molten metal supplied by the holding furnace 10 into the pouring ladle 1 and the molten metal that is being poured from the pouring ladle 1. Then the flow of the molten metal that actually flows from the pouring ladle 1 is calculated by having the flow of the molten metal that is supplied from the holding furnace 10 to the pouring ladle 1 added to the above difference in the flow.

In the unit for storing the flow-pattern 38 and the unit for storing the information of the quantity of molten metal that is required to be poured 41 of the equipment for control 30 are stored the data on the weight of the castings (the total weight of the molten metal that are to be poured in the molds) and the flow-pattern (a pattern that shows the relationship of the time elapsed to the flow of the molten metal that is poured). The unit for controlling the tilting of the pouring ladle 32 controls the tilting angle of the pouring ladle 1 based on the weight of the castings and the flow-pattern. The unit for controlling the tilting of the pouring ladle 32 determines at the predetermined intervals whether the flow of the molten metal that actually flows from the pouring ladle 1 matches the required flow of molten metal that is to be poured. If it determines that it does not, the unit for controlling the tilting of the pouring ladle 32 adjusts the angle of tilting the pouring ladle 1 by the mechanism to drive tilting 3 so as to have the flow of the molten metal from the pouring ladle 1 adjusted so that it matches the required flow of molten metal that is to be poured. The interval of adjusting the flow of the molten metal, for example, be set at 0.1 second.

Figure 8:
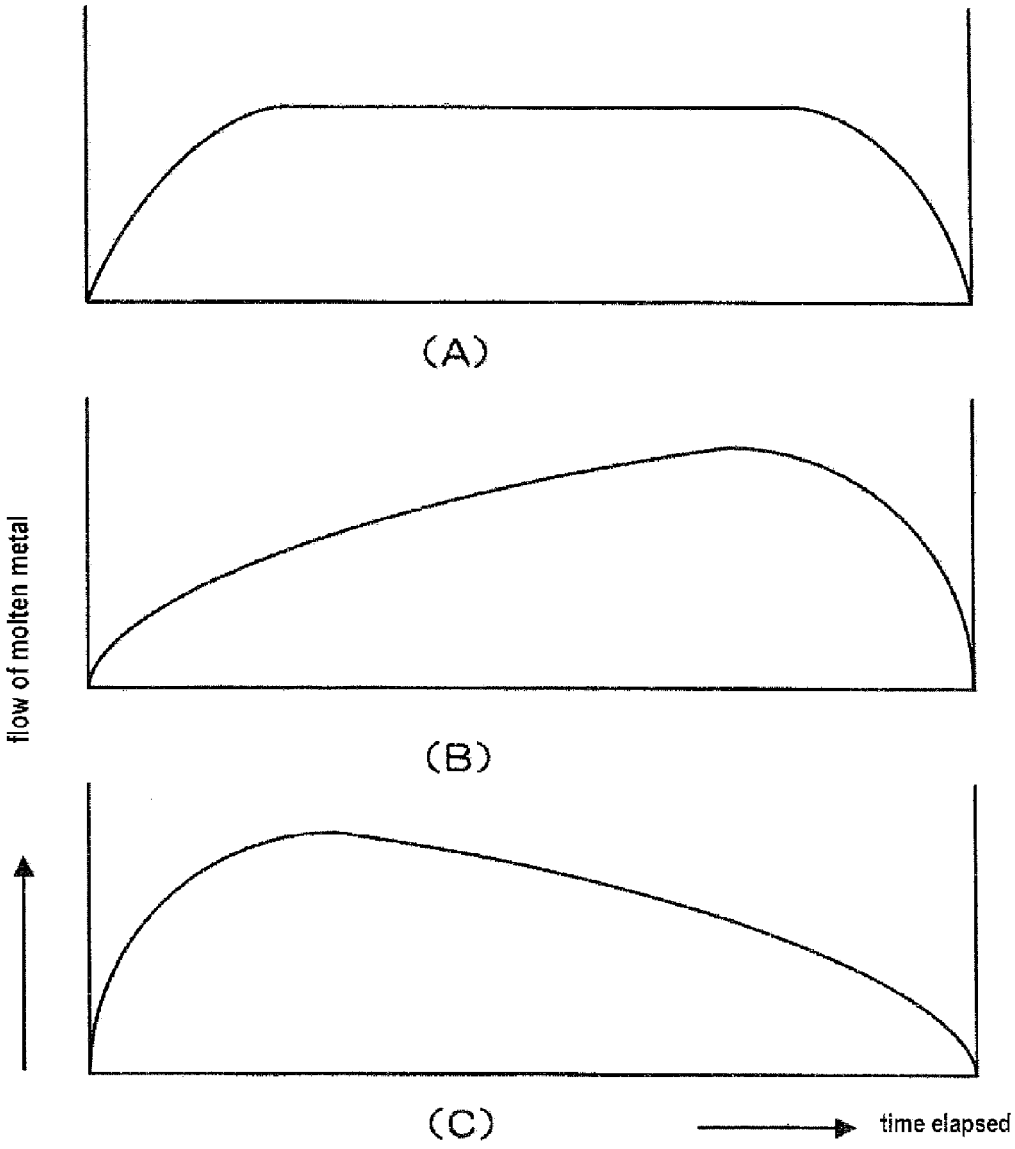
FIG. 8 is illustrations of flow patterns.

Examples of the flow-patterns are shown in FIG. 8.

FIG. 8 (A) shows a pattern where the flows of the metal that is poured is approximately constant against the time elapsed.

FIG. 8 (B) shows a pattern where the flow of the metal poured is less in the first half of the period and larger in the second half.

FIG. 8 (C) shows a pattern where the flow of the metal poured is larger in the first half of the period and less in the second half.

The unit for integrating the amount of the molten metal that is poured 42 calculates, during the pouring of the molten metal, the weight of the molten metal that is poured compared with the weight of the casting that is stored in the storage device, based on the weight of the molten metal in the pouring ladle 1, which weight is measured during the pouring. Then if the weight of the molten metal that is calculated reaches the predetermined weight of the molten metal, the pouring ladle 1 starts tilting backward by having the mechanism to drive tilting 3 drive backward whereby the pouring ladle 1 stops pouring the molten metal into the mold (see FIG. 4).

Then the transport line for molds (not shown) transports intermittently a group of molds M, of which the pouring is completed by one pitch (a distance that is equivalent to the movement of one mold) at a time and in the direction of the arrow Y1. In this way the mold M that is to be poured next is transported to the pouring stations (see FIG. 2). The same operations as explained above are repeated.

In the step where the pouring ladle 1 stops pouring the molten metal in the molds M and also in the step where the molds M are intermittently transported by one pitch at a time and in the direction of the arrow Y1, if the weight of the molten metal in the pouring ladle 1 does not reach the predetermined weight, then the holding furnace 10 continues to pour the molten metal in the pouring ladle 1 by being tilted forward. Throughout the operation the load cell 6 measures the weight of the molten metal in the pouring ladle 1 at the predetermined intervals (for example, at every 0.01 second). The unit for calculating the first flow 34 calculates the flow of the molten metal supplied from the holding furnace 10 to the pouring ladle 1 based on the weight of the molten metal that is measured. Then the flow of the molten metal supplied from the holding furnace 10 to the pouring ladle 1 is adjusted by adjusting the angle of the tilting of the holding furnace 10 in such a way that the flow of the molten metal thus calculated is sufficient to supplement the pouring ladle 1 so that the pouring ladle 1 can pour the molten metal sufficiently for each mold of the group of the molds that are intermittently transported.

If the amount of the molten metal in the holding furnace 10 is scarce, the molten metal must be supplied to the holding furnace 10. Next the supply of the molten metal to the holding furnace 10 is explained. For supplying the molten metal to the holding furnace 10, first the holding furnace 10 should be returned to the horizontal position by having the holding furnace 10 tilt backward, by the contraction of the cylinder for tilting 11 being. Then a ladle (not shown) that contains the molten metal is transported to the position near the holding furnace 10 by a hoist (not shown) disposed above the holding furnace 10. Then the molten metal in the ladle is supplied to the holding furnace 10 by the tilting of the ladle. In place of supplying the molten metal to the holding furnace 10, another holding furnace 10 that has already been supplied with the molten metal can be placed to the outside of one part of the pouring ladle 1, namely at the rear of the pouring ladle, while the holding furnace 10, which has been depleted of the molten metal, is being transported in the direction of the transport of the molds or its opposite direction by the mechanism to drive the holding furnace in the Y-direction.

As described above, the pouring ladle 1 can store the weight of the molten metal that is sufficient to be poured into a plurality of the molds. So, if the weight of the molten metal that is sufficient to be poured into a plurality of the molds is stored in the pouring ladle 1 before the molten metal is supplied to the holding furnace 10, then the pouring ladle 1 can pour the molten metal into the molds M even while the molten metal is being supplied to the holding furnace 10.

In one example, it takes about one minute from the start to the completion of filling the molten metal in one holding furnace 10, if the capacity of the holding furnace 10 that receives the molten metal is, 2000 kg, the capacity of the pouring ladle 1 is 150 kg, one pitch (for one mold) of the intermittent transport of the group of the molds is every 10.5 seconds, and the weight of the mold is about 10-30 kg, and in average 20 kg. If a pouring ladle 1 can hold 150 kg of the molten metal, the pouring ladle 1 can pour the molten metal into about 7 molds based on the calculation of 150/20 kg=7.5, where 20 kg of the molten metal is used per mold.

The molten metal that is equal to the total of the volumes of the 7 molds is poured per round of the pouring of the pouring ladle. So, there are seven numbers of the pitches in the intermittent transport of the molds and the total time required for the pouring is 7×10.5 seconds=73.5 seconds. Thus the pouring ladle 1 can continue to pour the molten metal even if it does not receive the molten metal from the holding furnace 10 for 73.5 seconds. That is, for about one minute, the time corresponding to the time from the start of the supply of the molten metal in the holding furnace 10 to its completion, the pouring ladle 1 does not run short of the molten metal even if the holding furnace 10 cannot supply the molten metal to the pouring ladle 1. And the pouring ladle 1 is not held in a standby position because of the shortage of the molten metal before it starts pouring. So, the pouring ladle 1 can continuously pour the molten metal into the molds M.

In the pouring equipment 20 of the present invention, the pouring ladle 1 can store the weight of the molten metal that is sufficient to be poured into a plurality of the molds. Also, from the start of the pouring the molten metal into the molds M untill the completion of the intermittent transport of the group of molds, the holding furnace 10 can continue to supply the molten metal into the pouring ladle 1 by being tilted in the forward direction if the weight of the molten metal in the pouring ladle 1 has not reached the predetermined level in weight. For this reason the pouring ladle 1 can continuously pour the molten metal in the molds M from the pouring ladle 1 even if it is used for a high-speed molding line where the intermittent transport of the molds is carried out at a relatively short time interval. So, the pouring equipment of the present invention does not cause a standby of the pouring ladle 1, because the ladle does not have sufficient molten metal. The predetermined level in weight as referred to above can be, for example, one where the molten metal that is supplied to the pouring ladle 1 to that level does not overflow. In this case the holding furnace 10 stops the supply of the molten metal to the pouring ladle 1 by being tilted backward if the weight of the molten metal in the pouring ladle 1 reaches that level.

The pouring equipment 20 measures the weight of the molten metal in the pouring ladle 1 at the predetermined interval while it pours the molten metal in the molds M. Based on the weight of the molten metal thus measured it calculates the difference in the flows between the molten metal supplied by the holding furnace 10 to the pouring ladle 1 and the molten metal that is being poured from the pouring ladle 1. Then the flow of the molten metal that actually flows from the pouring ladle 1 is calculated by having the flow of the molten metal that is supplied from the holding furnace 10 to the pouring ladle 1 added to the above difference in the flow.

Further, the weight of the molten metal in the pouring ladle 1 is measured at a predetermined interval in the steps of stopping the pouring the molten metal to the molds M and intermittently transporting the group of the molds. The flow of the molten metal supplied from the holding furnace 10 to the pouring ladle 1 is calculated based on the weight of the molten metal in the pouring ladle 1 thus measured. For this reason, the pouring equipment 20 can accurately grasp the flow of the molten metal that actually flows from the pouring ladle 1, even in the complex operation where the holding furnace 10 supplies the molten metal to the pouring ladle 1 by the forward tilting of the holding furnace 10 while simultaneously the pouring ladle 1 pours the molten metal in the molds M by the forward tilting of the pouring ladle 1. Further, even in the step of stopping the pouring of the molten metal into the molds M and in the step of intermittently transporting the group of the molds even if the holding furnace 10 supplies the molten metal to the pouring ladle 1 by the forward tilting of the holding furnace 10, the pouring equipment 20 can accurately grasp the flow of the molten metal that is supplied from the holding furnace 10 to the pouring ladle 1.

As explained above, the pouring equipment 20 of the present invention comprises the holding furnace 10, the pouring ladle 1, the device for measuring the weight of the molten metal (load cell 6), and the equipment for control 30, wherein the equipment for control 30 comprises the unit for storing results from measurements 33, the unit for calculating the first flow rate 34, and the device for calculating the second flow rate 35.

Also, the method of pouring of the present invention is one where the pouring equipment 20 is used to pour the molten metal in the molds, wherein, based on the information on the flow of the molten metal that is to be poured into the mold and that is obtained from the calculation by the device for calculating the second flow rate 35, the equipment for control 30 controls the pouring from the pouring ladle 1 by controlling the tilting of the pouring ladle 1 so that the pouring of the molten metal into the molds is carried out in accordance with the flow-patterns that correspond to the kinds of products, respectively.

The pouring equipment 20 of the present invention and the method of pouring using the pouring equipment can appropriately pour molten metal at a high speed corresponding to the speed of molding even if the molding is made at a high speed, while it prevents a bleeder from occurring or saves the time and money that is taken to maintain the equipment.

Also, the pouring equipment 20 and the method of pouring of the present invention comprise the equipment for control 30 and the use thereof, where the equipment for control 30 comprises the unit for storing the information on the amount of molten metal that is required to be poured 41, the unit for integrating the amount of the molten metal that is poured 42, and the unit for determining the time to stop the pouring by the pouring ladle 43, whereby pouring the molten metal at high speed as described above and stopping pouring the molten metal at an appropriate time in the appropriate automatic operation can be realized.

In the pouring equipment 20 of the present invention and the method of pouring, the equipment for control 30 comprises the unit for determining the tilting of the holding furnace 44 that has a function of monitoring the tilting of the holding furnace wherein the pouring at a high speed and the appropriate pouring can be realized.

In the pouring equipment 20 of the present invention and the method of pouring, the equipment for control 30 comprises the unit for determining the time to stop the pouring by the holding furnace 45, wherein the pouring at a high speed and an appropriate stopping of the pouring can be achieved. Also, the equipment for control 30 comprises the unit for determining the lower limit of the holding furnace 46, whereby the pouring at a high speed and the appropriate stopping of the pouring can be achieved.

For the pouring equipment 20, for example, when the pouring ladle 1 is tilted forward or backward, the pouring ladle 1 can also be moved in the X-direction by the mechanism to drive the pouring ladle in the X-direction 7 and moved up and down in the Z-direction by the mechanism to drive the pouring ladle in the Z-direction 8. Also, the holding furnace 10 can be moved in the X-direction, by the mechanism to drive the holding furnace in the X-direction.

In the above example, the pouring equipment 20 is explained where the pouring equipment 20 is used to pour the molten metal into the molds that are manufactured by a vertical flaskless molding line. However, the pouring equipment 20 of the present invention can also be used for the flaskless molds that are manufactured by a horizontal-split-type flaskless molding machine, or the molds with the molding flask that are manufactured by a horizontal-split-type tight-flask molding machine, etc.

Next, the second embodiment of the pouring equipment 120 is explained by referring to FIGS. 9-13. In this embodiment the pouring equipment 120 is, for example, automatic pouring equipment that is used to pour the molten metal in the molds M that are manufactured by the vertical flaskless molding machien 100 of FIG. 9.

Figure 9:
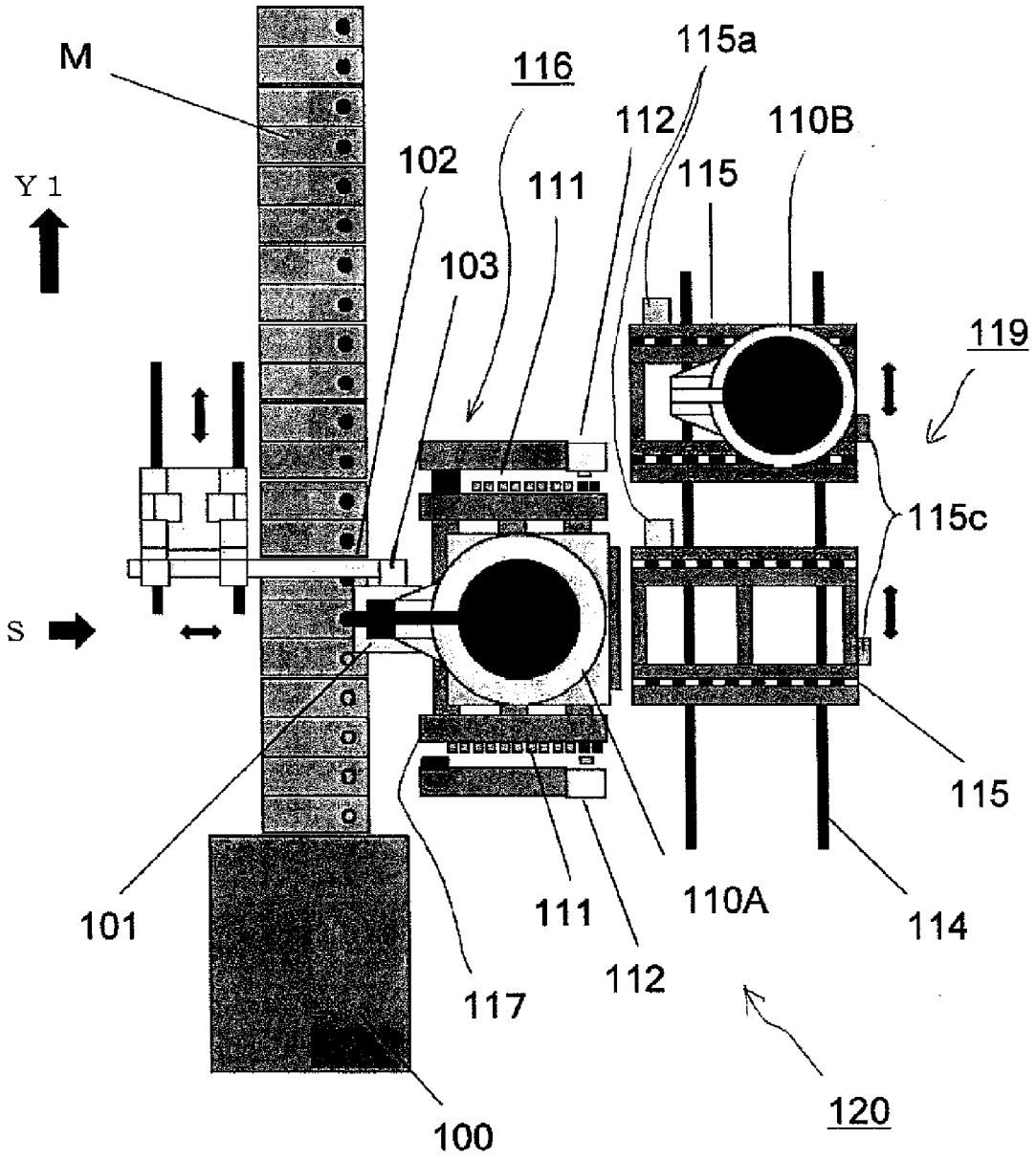
FIG. 9 is a plan view of the pouring equipment in the second embodiment.
Figure 10:
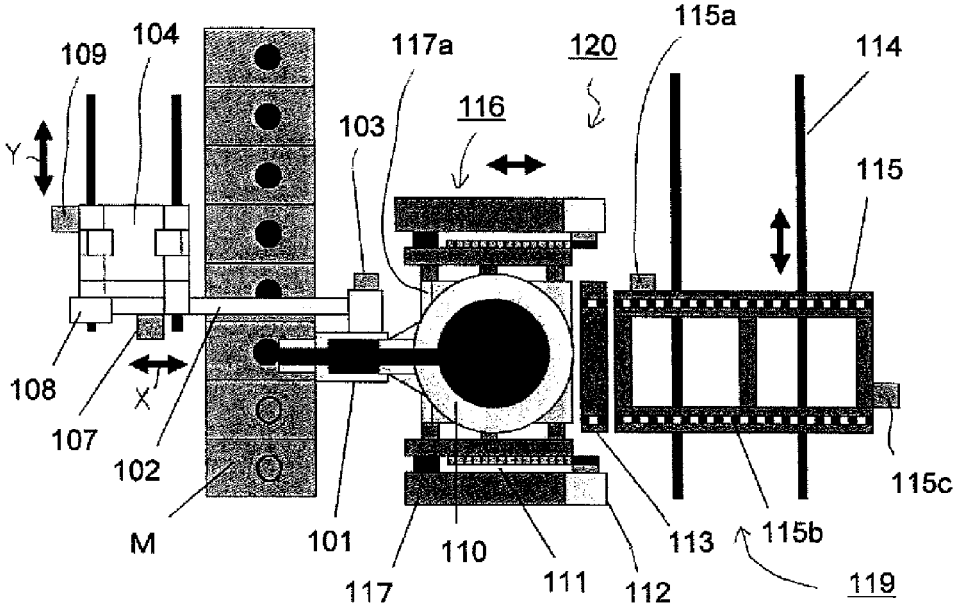
FIG. 10 is a plan view of the main part of the pouring equipment.
Figure 11:
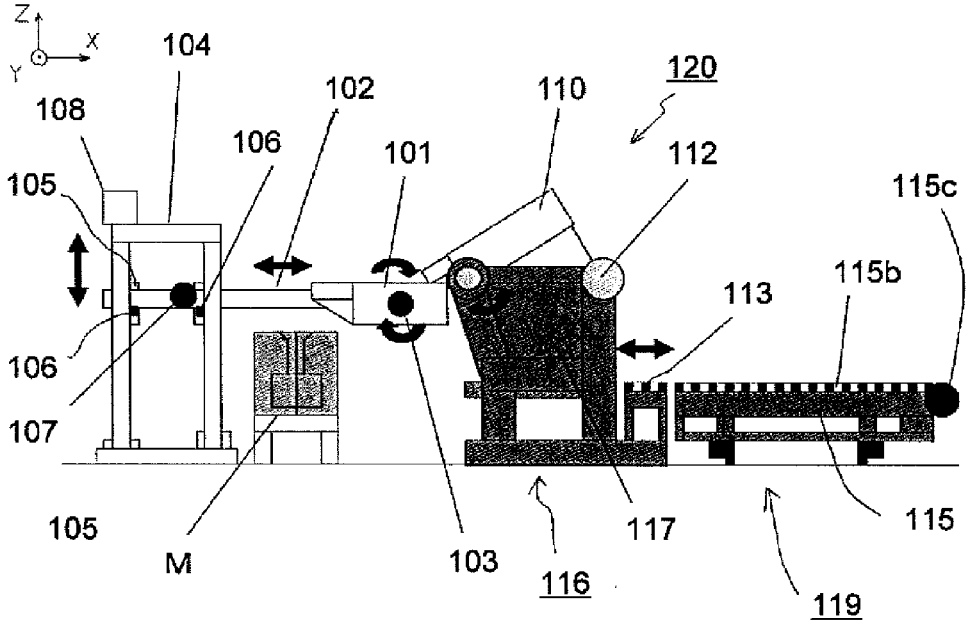
FIG. 11 is a front view of the pouring equipment.

As shown in FIGS. 9 to 11, the pouring equipment 120 comprises a pouring ladle 101 that pours the molten metal in the molds by being tilted, which molds are transported at interval, and two holding furnaces 110A and 110B (in the following explanation and in the drawings either of the two holding furnaces are referred to as "holding furnace 110" unless it is necessary to distinguish one from another) that can be transported, that can store and hold the molten metal, and that can supply (refill), by being tilted, the molten metal to the pouring ladle 101 at the position for supplying. The pouring ladle 101 stores the molten metal supplied from the holding furnace 110 and pours it into the molds M by being tilted, which molds are intermittently transported. In this embodiment, two holding furnaces are used but three or more furnaces can be used. In the second embodiment, the advantage of using at least two furnaces is explained. However, the same effects that are obtained if only one holding furnace is used, can be expected as from the pouring equipment 20 of the first embodiment.

Also, the pouring equipment 120 further comprises a transport line for holding furnace 119 that transports the holding furnaces 110A and 110B (rails 114 and roller-conveyor units 115), a device for tilting the holding furnace 116, which furnace is transported by the transport line for holding furnace 119 to the position for supplying the molten metal, and a load cell 106 as a device for measuring the weight of the molten metal in the pouring ladle 101.

In FIG. 11 the pouring ladle 101 is placed to the outside of one part of (right-hand side of FIG. 11) and above the mold M that is manufactured by the vertical flaskless molding machine. The pouring ladle 101 can store such an amount in weight of the molten metal that can be poured into a plurality of molds. A supporting arm 102 that extends in the horizontal direction is attached to one end of the pouring ladle 101. At the end of the supporting arm 102 is attached a mechanism to drive tilting 103 (for example, a motor) as a device for driving the tilting of the pouring ladle, which device tilts the pouring ladle 101.

The flow of the pouring ladle 101 is controlled, such that the pouring of the molten metal starts by the forward tilting of the pouring ladle 101, and during the pouring adjusting the tilting of the angle is made by the forward, backward tilting or the stopping of the tilting of the pouring ladle 101 (also referred to as "tilting movement"). Also, the speeds of the tilting are varied depending on the deviations of flows.

The pouring ladle 101 preferably has an inner shape formed in such a way that the area of the horizontal cross section (i.e., the surface of the molten metal) of the ladle is nearly constant regardless of the angle of tilting the ladle. Such a shape can include, for example, a shape of a fan, a rectangle, a square, or the like on its longitudinal cross section.

A traversing frame 104 that can move in the Y-direction of FIG. 11 is disposed to the outside of the other part of the mold M. A lifting frame 105 is attached to the traversing frame 104 in such a way that the lifting frame 105 can move up and down. To the upper part of the lifting frame 105 is attached the supporting arm 102 that can move backward and forward. In the present embodiment, to move "backward and forward" means a movement in the X-direction as shown in FIG. 11.

A load cell 106 as a device for measuring weight of the molten metal, which device measures the weight of molten metal in the pouring ladle 101, is attached to the lifting frame 105. The device for measuring weight that constitutes the pouring equipment 120 is not limited to the load cell 106 but another measuring unit can be used. The weight of the molten metal in the pouring ladle 101 can be obtained by subtracting the tare weight that was measured in advance from the weight measured by the load cell 106.

Further, a mechanism to drive in the X-direction 107 (for example, a motor) that drives the pouring ladle 101 in the X-direction is attached to the lifting frame105. As shown in FIG. 1, the X-direction is the direction that is perpendicular to a Y-direction. The Y-direction is the one in which the molds M move. The pouring ladle 101, together with the supporting arm 102, can be moved in the X-direction by the mechanism to drive in the X-direction 107.

Further, a mechanism to drive in the Z-direction 108 (for example, a motor) that drives the pouring equipment 101 in the Z-direction is attached to the lifting frame 105. The Z-direction is the direction that forms right angles with the X-direction and Y-direction, i.e., the up-and-down direction. The pouring ladle 101 can move up and down, together with the lifting frame 105 and the supporting arm 102, driven by the mechanism to drive in the Z-direction.

A mechanism to drive in the Y-direction 109 (for example, a motor) that moves the pouring ladle 101 in the Y-direction is attached to the traversing frame 104. The pouring ladle 101 can move up and down in the Y-direction, together with the lifting frame 105 and the supporting arm 102, by the mechanism to drive in the Y-direction 109 (the direction Y1 which is the direction the molds M move and its reverse direction).

The holding furnace 110 stores the molten metal and pours it by being tilted into the pouring ladle 101 while the holding furnace 110 is at the position for supplying the molten metal, which position is to the outside of the one part of the pouring ladle 101. That is, a device for tilting the holding furnace 116 is disposed at the position to the outside of the one part of the pouring ladle 101, which device is to tilt the holding furnace 110 that is transported to the position by the transport line for holding furnace 119. The holding furnace 110 supplies the molten metal to the pouring ladle 101 in such a way that the supply of the molten metal to the pouring ladle 101 is maintained constant. So, it is tilted forward when it supplies the molten metal to the pouring ladle 101 and tilted backward when it stops supplying the molten metal.

The transport line 119 that transports the holding furnace 110 comprises the rails 114 that are laid parallel to the direction of the transport of the molds, i.e., the Y-direction, a pair of roller-conveyor units 115 that are movable on the rails 114 in the Y-direction, and devices for driving the roller-conveyor unit 115*a* that move the respective rollerconveyor units 115 in the Y-direction. The roller-conveyor units 115 can be provided in three numbers or more. The roller-conveyor unit 115 comprises a member for rollers 115*b* that transports the holding furnace 110 in the X-direction, which is perpendicular to the Y-direction and also comprises a device for driving the rollers 115*c* that moves the member for rollers 115*b*. The transport line 119 transports the roller-conveyor unit 115 in the Y-direction by the device for driving the roller-conveyor unit 115*a* and the device for driving the rollers 115*c*. The holding furnace that is placed at the predetermined position is transported in the X-direction, whereby the holding furnace 110A is placed on the device for driving the tilting of the holding furnace 116 at the position for supplying the molten metal and the holding furnace 110B is transported to the position to have the molten metal filled. That position is on the side of the melting furnace where the molten metal is filled in the holding furnace.

Figure 12:
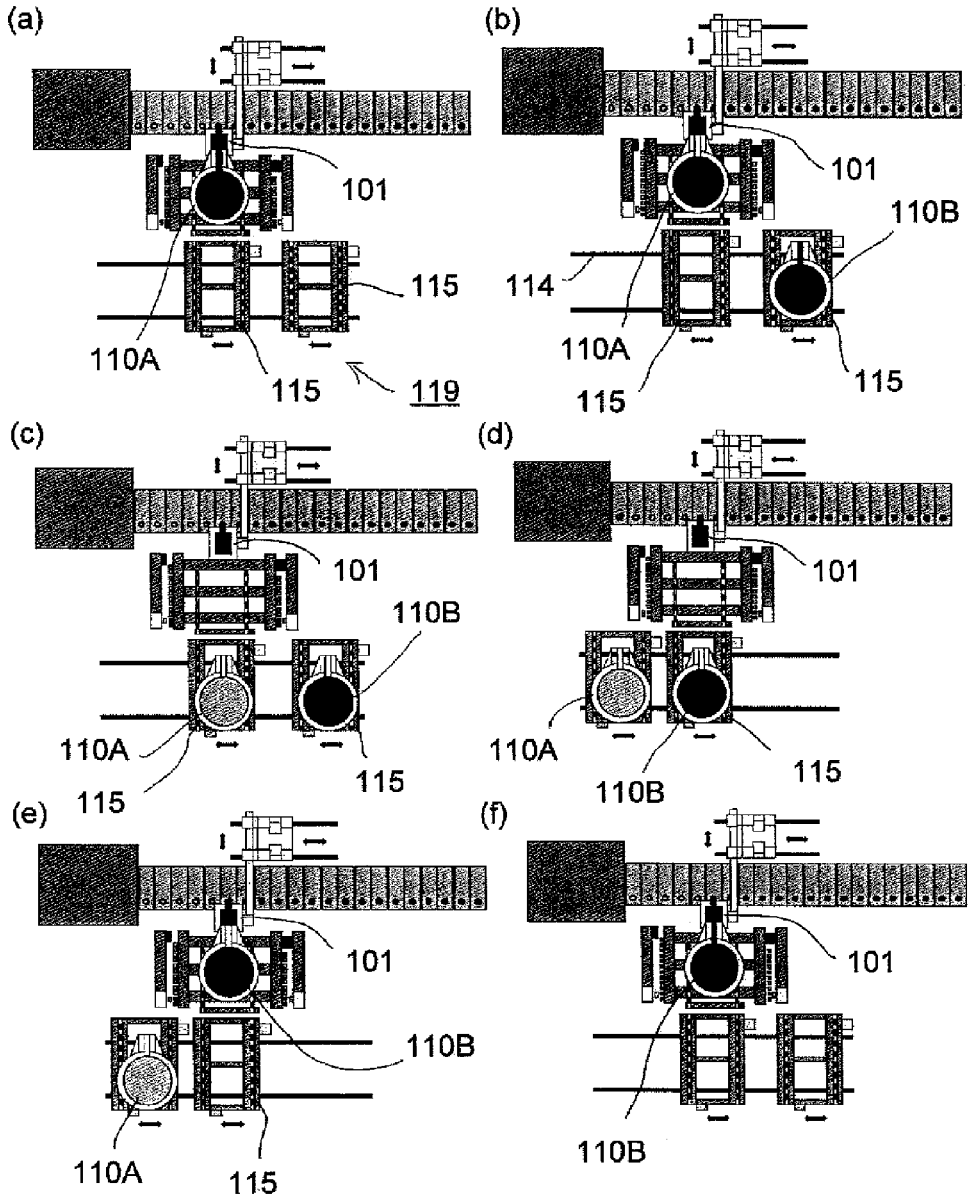
FIG. 12 gives illustrations that show the movements of the holding furnaces of FIG. 9, where one furnace is changed for another.

Thus as shown in FIGS. 12 (*a*)-(*f*), by transporting the holding furnaces 110A and 110B, the transport line 119 changes one holding furnace that is at the position for supplying the molten metal for another. Below the process of changing the holding furnaces are explained.

The device for driving the tilting of the holding furnace 116 comprises a tilting frame117, which is tiltable, a sector gear 111 attached to the tilting frame 117, and a motor for tilting the frame 112 by means of this sector gear 111. Also, a roller conveyor 113, which transports, to a predetermined position, the holding furnace 110 that was carried in from the side of the roller-conveyor unit 115, and an endpositioning device 117*a*, which determines the position of the holding furnace 110 that was transported by the roller conveyor 113 are attached to the tilting frame 117. The holding furnace 110 is transported to the position where it contacts the end-positioning device 117*a*. That is the position for supplying the molten metal, i.e., where the holding furnace 110 supplies the molten metal in the pouring ladle 101. The holding furnace 110 that was transported to the position for supplying the molten metal pours the molten metal in the pouring ladle101 by the tilting of, and together with, the tilting frame 117, which tilts the holding furnace 110. The device for driving the tilting of the holding furnace 116 and a device for driving the tilting of the holding furnace 126, which will be explained below, tilt the holding furnace 110 forward under the conditions (basically the speed of tilting is constant) whereby the flow of the molten metal that is supplied from the holding furnace 110 in the pouring ladle 101 is always constant. That is, the flow of the molten metal (the flow per unit of time) is controlled such that the flow of the molten metal that is supplied from the holding furnace 110 to the pouring ladle 101 is the same whether or not the pouring ladle 101 pours the molten metal in the ladle. More particularly, to achieve this, the data on the speed of tilting, which data controls the tilting of the holding furnace 110, are to be stored in advance, so that the flow of the molten metal that is supplied from the holding furnace 110 to the pouring ladle 101 is the same whether the pouring ladle 101 pours the molten metal in the ladle 101 or not. The device for driving the tilting of the holding furnace 116 that tilts the holding furnace 110 can be moved in the Xdirection by the mechanism to drive the holding furnace in the X-direction (not shown). It can also be designed to move in the Y-direction with the mechanism to drive the holding furnace in the Y-direction. The device for driving the tilting of the holding furnace 116 thus constituted can move in both the X-direction and Y-direction and can follow the movements in the X-direction and Y-direction of the pouring ladle 101.

Figure 13:
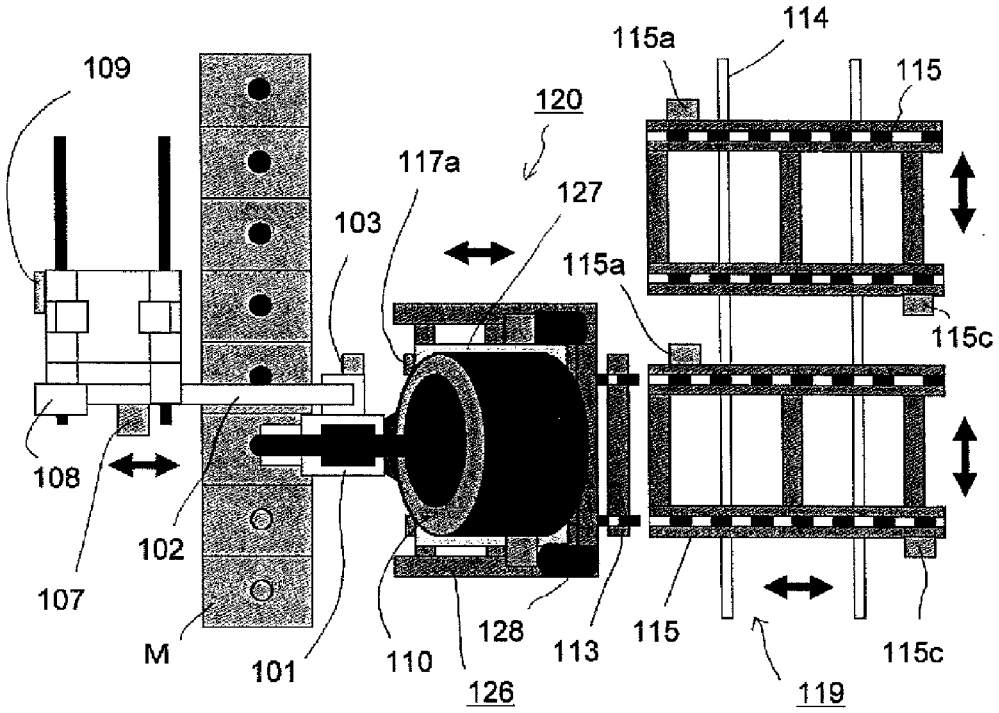
FIG. 13 is a plan view of one variation of the pouring equipment of FIG. 9 for the second embodiment where the pouring equipment comprises a cylinder-type device for tilting the holding furnace.
Figure 14:
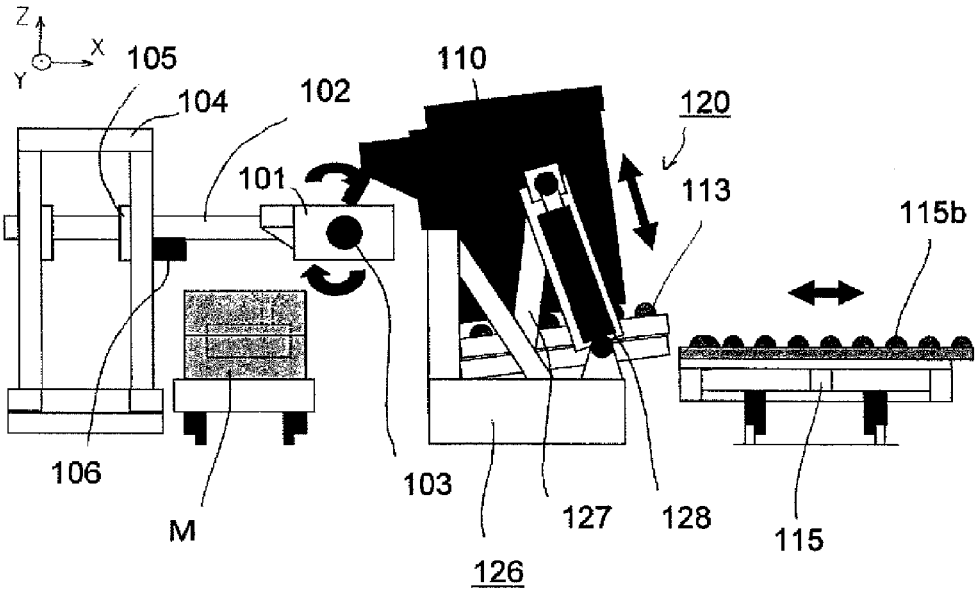
FIG. 14 is a front view of the pouring equipment shown in FIG. 13.

In the present embodiment the device for tilting the holding furnace 116 that uses a sector-gear is explained. However, the device for driving the tilting of the holding furnace is not limited to this type, but it can also use a device for driving the tilting of the holding furnace of the cylinder-type 126 as shown in FIGS. 13 and 14. The pouring equipment as shown in FIGS. 13 and 14 is constituted in the same way as the pouring equipment as shown in FIGS. 9 to 12, except for the device for driving the tilting of the holding furnace. So, the same components in both the pouring equipment are referred to by the same number and thus a detailed explanation is omitted for such components. A device for driving the tilting of the holding furnace 126 of the cylinder-type, which is tiltable, comprises a tilting frame 127 that is tiltable, having an end-positioning device117*a* and a roller-conveyor 113, and a cylinder for tilting 128 that tilts the tilting frame 127. The holding furnace 110 that is transported to the position for supplying the molten metal, which position is adjacnet to the end-positioning device 117*a*, pours the molten metal into the pouring ladle 101 while it is tilted together with the tilting frame 127.

Also, the device for driving the tilting of the holding furnace 126 that tilts the holding furnace 110 can be designed in such a way that it moves in both the X-direction and the Y-direction. The device for driving the tilting of the holding furnace 126 thus constituted can follow the movements in both the X- and Y-directions of the pouring ladle 101. That is, the devices for driving the tilting of the holding furnace 116 and 126 can be designed so that they can move in the X-direction with the device for driving the tilting of the holding furnace in the X-direction (not shown) and in the Y-direction with the device for driving the tilting of the holding furnace in the Y-direction (not shown). Also, in place of the device for driving the tilting of the holding furnace of the sector gear-type or cylinder-type, a device for driving the tilting of the holding furnace adopts a type where the supply can be carried out sequentially.

The pouring equipment 120 comprises equipment for control 30 that controls the tiltings of the holding furnace 110 and the pouring ladle 101, based on the information as measured by the load cell 106, or the like, which is the device for measuring weight, and equipment for control 150 that controls the transport of the holding furnace 110, which transport is carried out by the transport line. The structure and the function of the quipment for control 30 are the same as those explained in the first embodiment by referring to FIGS. 5-7. So, a detailed explanation is omitted. In this embodiment the equipment for control 30 is prepared as an independent component, which is separate from the equipment for control 150, which is explained in detail below. But a single device that comprises the function of the equipment for control 30 and the function of the equipment for control 150 can be used.

Figure 15:
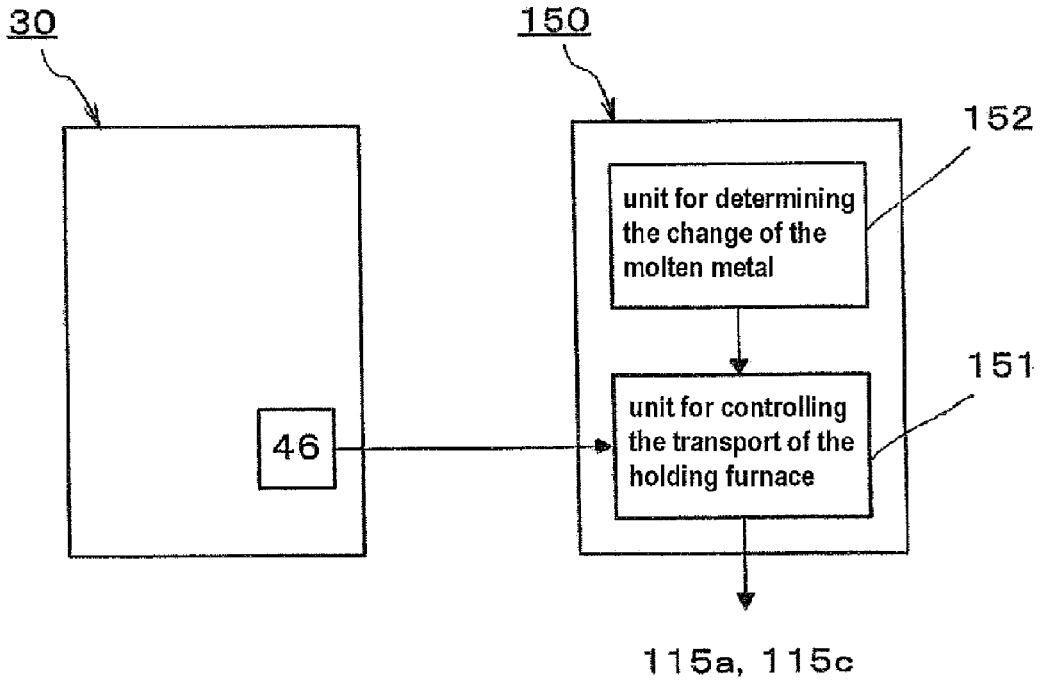
FIG. 15 is a schematic diagram of the equipment for control that constitutes the pouring equipment.

The equipment for control 150 consists of an apparatus for control and processing comprising an input unit, a processing and calculating unit, a memory, a display unit, an output unit, a storage unit, etc. The apparatus for control and processing reads out the programs stored in the storage unit into the memory and carries out the predetermined processing by the processing and calculating unit that functions as the evaluation unit and the control unit, which are explained below. That is, as shown in FIG. 15, the equipment for control 150 comprises a unit for controlling the transport of the holding furnace151 that controls the transport line 119 and a unit for determining the change of the molten metal 152.

The unit for determining the change of the molten metal 152 determines whether the type of molten metal is to be changed (a change of materials), based on the instructions from the computer to control all the facilities, or by the user's instructions. When it approaches the time to change the type of molten metal, more particularly if the unit for determining the change of the molten metal 152 determines that there are several molds left to be poured before the type of molten metal is to be changed, then the unit for determining the change of the molten metal 152 sends a signal to the unit for controlling the transport of the holding furnace 151, indicating that the holding furnaces are to be changed. Also, the signal from the unit for determining the change of the molten metal 152, indicating that the type of molten metal is to be changed, can be sent to the unit for determining the time to stop the pouring by the holding furnace 45 of the equipment for control 30. Also, the computer to control all the facilities can send this signal.

If the unit for controlling the transport of the holding furnace 151 receives a signal, indicating that the holding furnaces are to be changed, from the unit for determining the lower limit of the holding furnace 46 of the equipment for control 30, or if it receives a signal, indicating the change of the holding furnaces, from the unit for determining the change of the molten metal 152, then the unit for controlling the transport of the holding furnace 151 controls the transport line 119 and has it transport the holding furnace and has the holding furnaces changed. More particularly, the unit for controlling the transport of the holding furnace 151 controls the device for driving the roller-conveyor unit 115*a* and the device for driving the rollers 115*c* and has them change the one holding furnace for another as shown in FIGS. 12 (*a*)-12 (*f*). Namely, for example, as shown in FIG. 12, the holding furnace 110A, which is at the position for supplying the molten metal, is to be changed for the next holding furnace 110B. In the unit for determining the lower limit of the holding furnace 46 of the equipment for control 30 of the pouring equipment 120 are stored the data for the lower limit of the holding furnace for determining the timing of stopping the pouring of the molten metal and also the threshold value that indicates that the amount of the molten metal that remains in the holding furnace can be poured into only several molds. The unit for determining the lower limit of the holding furnace 46 determines whether the amount of the molten metal in the holding furnace 110 is below its lower limit and also determines whether it is lower than the threshold value that shows that the holding furnaces is to be changed for another, based on the total molten metal that was poured and that was calculated by the unit for integrating the amount of the molten metal that is poured 42. In this embodiment the signal indicating the change of the holding furnaces is sent when the amount of the molten metal that remains in the holding furnace is sufficient to be poured into several molds.

But the pouring ladle 101 of the pouring equipment 120 can store the molten metal that can be poured into a plurality of the molds. So, the lower limit can also be used as the threshold value that indicates the change of the holding furnaces.

The movements of the automatic pouring equipment 120 of the present invention are explained below. Like the automatic pouring equipment 20, that was explained above the pouring equipment 120 controls the tiltings of the holding furnace and of the pouring ladle depending on the respective requirements. It uses, as the information for the control of the tiltings, the results of measurement obtained by the device for measuring weight (load cell 106) that is commonly used for the holding furnace 110 and the pouring ladle 101.

The control of the tilting the holding furnace and the control of the tilting of the pouring ladle and the movements of the pouring equipment 120 are in general the same as for the pouring equipment 20, as explained based on FIGS. 6-8, except that the change of the holding furnace 110 occurs in the pouring equipment 120. So, the detailed explanation is omitted. That is, in the pouring equipment 20, the molten metal is added to the holding furnace 10 if the amount of the molten metal in the holding furnace 10 becomes scarce. But in the pouring equipment 120, if the amount of the molten metal in whichever of the holding furnaces 110A and 110B that was pouring the molten metal into the pouring ladle 101 becomes scarce, the other furnace that had the molten metal supplied in advance and was put on standby (for example, the holding furnace 110B in FIG. 12 (*b*)) takes place of the holding furnace, of which the amount of the molten metal becomes scarce.

Next, the change of the holding furnaces 110A and 110B of the automatic pouring equipment 120 is explained in detail. The change of the holding furnaces starting from the following situation is explained: First the holding furnace 110A is at the position for supplying the molten metal, as shown in FIG. 12 (*a*), and is operated under normal conditions. Then the amount in the holding furnace 110A at the position for supplying the molten metal becomes scarce. FIG. 12 (*a*) is a schematic illustration that shows the pouring ladle 101 that pours the molten metal into the mold W while the holding furnace 110 pours the molten metal into the pouring ladle 101.

The operation of the pouring equipment continues from the situations shown in FIG. 12 (*a*). If the amount of the molten metal in the holding furnace 110A becomes scarce and then drops below the predetermined threshold value that indicates a change of the furnaces, then the unit for determining the lower limit of the holding furnace 46 sends a signal to the unit for controlling the transport of the holding furnace 151 of the equipment for control 150, indicating that the holding furnace is to be changed for another. The unit for controlling the transport of the holding furnace 151 that received the signal that indicated that the holding furnace is to be changed for another has the holding furnace 110A withdrawn from the position for supplying by driving a pair of roller-conveyor units 115 in line with the procedures given in FIGS. 12 (*b*) to (*f*). It then transports the holding furnace 110B that is filled with the molten metal to the position for supplying. In the present embodiment the case where the amount of the molten metal in the holding furnace 110A becomes scarce and drops below the predetermined threshold value that indicates a change of the furnaces was explained. But for changing the type of molten metal to the other type, the similar procedures that are explained below are applied, wherein the holding furnace 110A is changed for the holding furnace 110B that is filled with the molten metal of another type and the signal indicating that the holding furnace is to be changed for another holding furnace is sent from the unit for determining the change of the molten metal 152, as described above.

First, as shown in FIG. 12 (*b*), the equipment for control 150 puts the holding furnace 110B that is filled with the molten metal on standby and that was transported in the Y-direction from the position of a furnace for melting.

At the position for supplying, the normal operation is in progress. Namely, the holding furnace 110 A pours the molten metal into the pouring ladle 101 and the pouring ladle 101 pours the molten metal into the mold W. The position where the holding furnace 110B is placed in FIG. 12 (*b*) is also referred to as the standby position.

Next, as shown in FIG. 12 (*c*) the equipment for control 150 has the holding furnace 110 A withdrawn from the position for supplying the molten metal.

The roller-conveyor 113 of the device for tilting the holding furnace 116 and the member for rollers 115 *b* of the roller-conveyor unit 115 carry out the holding furnace 110A. Throughout this period the pouring ladle 101 pours the molten metal into the mold W. The position in FIG. 12 (*c*) where the holding furnace that is withdrawn is referred to as the position of transfer. In other words, the position of transfer is the one that faces to the position for supplying the molten metal in the X-direction.

Next, the equipment for control 150 moves the holding furnace 110B to the position of transfer by transporting the holding furnace 110A from the position of transfer and the holding furnace 110B from the standby position, both in the Y-direction at the same time. All these movements are carried out by a pair of roller-conveyor units 115 of whose actions are coordinated.

The pouring ladle 101 continuously pours the molten metal into the mold W. The position to which the holding furnace 110A is withdrawn in the Y-direction and then moved in the movement that is coordinated with the holding furnace 110B is referred to as the position of retreat.

Next, as shown in FIG. 12 (*e*), the equipment for control 150 has the holding furnace 110B transported in the position for supplying from the position of transfer. The transport of the holding furnace 110B is carried out by the member for rollers 115*b* of the roller-conveyor unit 115 and the roller-conveyor 113 of the device for driving the tilting of the holding furnace 116. Throughout the time the pouring ladle 101 pours the molten metal into the molds W. The holding furnace 110B that was transported into the position for supplying the molten metal pours the molten metal into the pouring ladle 101 while the holding furnace 110B is tilted by the device for driving the tilting of the holding furnace 116. The tilting of the holding furnace 110B starts if the unit for determining the time to supply the pouring ladle 47 of the equipment for control 30 determines the molten metal in the pouring ladle 101 is below the predetermined level.

Next, as shown in FIG. 12 (*f*), the equipment for control 150 has the holding furnace 110 A, which was withdrawn, which was placed on the roller-conveyor unit 115, and which was kept at the positions as shown in FIG. 12 (*d*) and (*e*), transported to the position to fill the molten metal (not shown). Throughout this time the normal operation is in progress at the position for supplying the molten metal. That is, the holding furnace 110 B that replaced the holding furnace 110 A pours the molten metal into the pouring ladle 101, while the pouring ladle 101 pours the molten metal into the mold W. The change of the holding furnaces is carried out by the operation of the transport line 119, but the movements of the holding furnaces are not limited to those of the embodiment that are explained above. The change of the holding furnaces can be carried out on the basis that the standby position and the position of retreat are switched.

The pouring equipment 120 of the present invention comprises the holding furnaces 110 A and 110B, the pouring ladle 101, the device for measuring weight (load cell 106), and the equipment for control 30 and 150. The equipment for control 30 comprises the unit for storing results from measurements 33, the unit for calculating the first flow rate 34 and the unit for calculating the second flow rate 35. Also, the pouring method of the present invention provides the method of pouring the molten metal into the mold using the pouring equipment 120, wherein the pouring is controlled by tilting the pouring ladle 101, similarly to the control by the equipment for control 30 wherein it has the pouring ladle 101 pour the molten metal into the mold in accordance with the flow-pattern that correspond to the kinds of products, based on the information that is calculated by the device for calculating the second flow rate 35 on the flow of the molten metal that is poured into the mold. The pouring equipment 120 of the present invention and the method of pouring using the pouring equipment in the embodiments as above explained prevents a bleeder from occurring and saves the time or money to maintain the equipment by adopting a tilting system. The pouring equipment 120 of the present invention and the method of pouring using the pouring equipment can appropriately pour the molten metal and at the high speed corresponding to the speed of molding even if the molding is made at a high speed. The pouring equipment 120 of the present invention can produce an effect similar to that of the pouring equipment 20.

The pouring equipment 120 of the present invention and the method of pouring thereof are characterized in that the holding furnace can be transported and tilted at the position for supplying so that it pours the molten metal into the pouring ladle and in that at least two holding furnaces are provided. Namely, the pouring equipment 120 of the present invention comprises the holding furnaces 110A and 110B as seen above. The pouring equipment 120 further comprises the transport line 119, the device for driving the tilting of the holding furnace 116 that controls the tilting of the holding furnace that was transported by the transport line 119 to the position for supplying the molten metal. The equipment for control 30 and equipment for control 150 control the tiltings of the holding furnaces 110A and 110B and the tilting of the pouring ladle 101. Also, the equipment for control 30 and equipment for control 150 control the transport by the transport line 119 of the holding furnaces 110A and 110B, thereby the following advantageous effects being obtained: the consumption of energy is minimized, the change of the type of molten metal can be advantageously effected, and the pouring can be appropriately carried out at the high speed corresponding to the speed of molding even if the molding is made at a high speed. From the advantageous effects as referred to above, below are explained the effect that occurs where the consumption of energy is minimized. Also, it is explained how the change of the type of molten metal can be advantageously effected.

The pouring equipment 20 of the first embodiment of the present invention has an effect that was not known before, in that it can pour molten metal at a high speed. However it may take a long time, for example, to reheat a furnace when changing the material (the type of molten metal). One method to avoid this problem would be to change melting furnaces or holding furnaces by using an apparatus to do so. But in this case the scale of the pouring equipment itself becomes very large and the energy loss because of reheating the furnace for melting or the holding furnace will possibly be great. The pouring equipment 120 of the present invention and the method of using the pouring equipment 120 can solve these problems because they can minimize the energy loss and also can advantageously change the type of molten metal.

Also, they can appropriately pour the molten metal at the high speed, one that corresponds to the speed of molding even if the molding is carried out at a high speed.

Further, the pouring equipment 120 comprises the pouring ladle 101, the holding furnaces 110A and 110B that are transportable, an apparatus for supplying the molten metal that tilts the holding furnace 110 (a device for tilting the holding furnace 116), and an apparatus for automatically changing the holding furnaces that automatically changes the empty holding furnace 110 for the holding furnace 110 filled with the molten metal (transport line119).

The method using the pouring equipment 120 provides a method of pouring the molten metal into the mold wherein the apparatus for automatically changing the holding furnaces transports the holding furnace 110 and places it onto the apparatus for supplying the molten metal, whereby the apparatus for supplying the molten metal tilts forward the holding furnace 110 filled with the molten metal, and has the holding furnace 110 pour the molten metal into the pouring ladle 101, while the pouring ladle 101 by being tilted forward pours the molten metal into the predetermined mold of the group of the molds that are intermittently transported, wherein the method comprises the steps of:

pouring the molten metal of the pouring ladle 101 into the mold W by tilting forward the pouring ladle 101;

tilting backward the pouring ladle 101 and stopping the pouring of the molten metal into the mold W;

intermittently transporting the group of molds that include the mold W, of which the pouring is completed;

preparing the holding furnace that is filled with the molten metal (e.g., 110B) while the pouring ladle 101 pours the molten metal;

withdrawing the holding furnace (e.g., 110A) when it was depleted of the molten metal;

transporting the holding furnace that is filled with the molten metal and that is standing by (e.g., 110B) to the position of transfer; and transporting the holding furnace that is filled with the molten metal and that is at the position of transfer (e.g., 110B) to the apparatus for supplying the molten metal;

wherein in the method using the pouring equipment 120, all through the steps from the start of the pouring of the molten metal in the mold W to the completion of the intermittent transport of the group of the molds, the pouring equipment 120 has the holding furnace 110A or 110B continuously pour the molten metal into the pouring ladle 101 by tilting forward the holding furnace 110A or 110B if the amount of the weight of the molten metal in the pouring ladle 101 is below the predetermined level. That is, in the steps of pouring the molten metal into the molds by the pouring ladle 101, the pouring equipment 120 of the present invention enables the pouring ladle 101 to continuously pours the molten metal by having the holding furnace 110 that has been depleted of the molten metal be withdrawn and changing it for another holding furnace 110 filled with the molten metal. In other words, if the holding furnace 110 pours out all its supply, the holding furnace 110 that is empty is withdrawn before the pouring ladle 101 pours out all the molten metal it has, and the holding furnace 110 that was filled with the molten metal in advance and was standing by is transported to the position of transfer. Then it is placed in the apparatus for supplying the molten metal, where the holding furnace 110 that was filled with the molten metal pours the molten metal into the pouring ladle 101 by being tilted forward. Thus the pouring equipment 120 can operate continuously without having the pouring being interrupted. If any change of the material (the type of molten metal) is required, the holding furnace 110 having the present material (e.g., 110A) can be withdrawn, after it supplies to the pouring ladle 101 such an amount of the molten metal of the present material that is equivalent to the amount that the pouring ladle 101 will pour into the molds within a period of time that is required for a change of the furnaces. And then the holding furnace having the new material that is standing by (e.g., 110B) is transported to the position of transfer and then placed onto the apparatus for supplying the molten metal. Then it can pour the molten metal of the new material into the pouring ladle 101. So the pouring equipment 120 and the method using the pouring equipment 120 can produce various effects including supplying the molten metal of new material to the pouring ladle 101 by having the holding furnace being tilted forward.

In the pouring equipment 120 and the method using the pouring equipment, the pouring ladle 101 can store the molten metal that is equivalent to the supply of a plurality of the molds. Further, from the start of the pouring of the molten metal into the mold W to the completion of the intermittent transport of the group of the molds, the pouring equipment 120 has the holding furnace 110A or 110B continuously pour the molten metal into the pouring ladle 101 by tilting forward the holding furnace 110A or 110B if the amount of the weight of the molten metal in the pouring ladle 101 is below the predetermined level. For this reason the pouring equipment of the present invention can continuously pour the molten metal in the molds M from the pouring ladle 101 without causing a shortage of the molten metal in the pouring ladle even it is used for a high-speed molding line where the intermittent transport of the molds is carried out at a relatively short time interval, thus causing no standby of the pouring ladle 101. The pouring ladle 101 can have the predetermined level in weight of the molten metal, which, for example, can be the maximum level, over which level the molten metal may overflow the ladle. If the molten metal in the pouring ladle 101 reaches the predetermined level in weight, the holding furnace 110 stops pouring the molten metal into the mold by being tilting backward. Also, these movements are the same as in the pouring equipment 20 and the method using the pouring equipment 20.

In the pouring equipment 120 and the method using the pouring equipment 120, the pouring ladle 101 can be moved in the X-direction, which is perpendicular to the direction of the transport of the molds, by the mechanism to drive in the X-direction 107 in various operations. Also, the pouring ladle 101 can be moved up and down by the mechanism to drive in the Z-direction 108. For example, when the pouring ladle 101 is tilted forward or backward, the pouring ladle 101 can be moved in the X-direction or it can be moved up and down at the same time. These movements are the same as those for the pouring equipment 20 and the method of pouring using the pouring equipment 20.

In the pouring equipment 120 and the method using the pouring equipment 120, the holding furnace 110 can be moved in the X-direction, which is perpendicular to the direction of the transport of the molds, by the mechanism to drive the pouring ladle in the X-direction, in various operations.

Also, when the amount of the molten metal in the holding furnace 110 becomes scarce, then in place of supplying the molten metal in that holding furnace 110, both holding furnaces may be operated such that (1) the one holding furnace, of which the molten metal is scarce, is transported by the mechanism to drive the pouring ladle of the device for driving the tilting of the holding furnace, either in the direction that the molds are transported or the direction opposite to it, i.e., the Y-direction, and then (2) the other holding furnace 101 that was filled in advance with the molten metal is placed to the outside of the one part of the pouring ladle 101, namely, at the rear of the pouring ladle 101.

In the above embodiment, one example is explained wherein the pouring equipment 120 and the method of pouring using the pouring equipment 120 are applied to the pouring of the molds manufactured by a vertical flaskless molding machine. But the molds that can be used by the pouring equipment 120 and by the method using the pouring equipment 120 are not limited to them. They include such molds as a flaskless mold manufactured by a horizontal-split-type flaskless molding machine, and a mold with a flask manufactured by a horizontal-split-type tight-flask molding machine. Likewise, the pouring equipment 20 and the method using the pouring equipment 20 can also use those molds.

Each holding furnace 10, 110, 110A, 110B, of the pouring equipment 20, 120 comprises not only a furnace that has a heating device to maintain the temperature of the molten metal that is stored and held in the furnace, but it also comprises a furnace that does not have a heating device and only stores the molten metal in the furnace. It also comprises a furnace (melting furnaces) that has a heating device that heats solid metal and changes it to liquid metal (molten metal).

The basic Japanese Patent Applications, No. 2010-189024, filed Aug. 26, 2010, and No. 2010-269587, filed Dec. 2, 2010, are hereby incorporated in its entirety by reference in the present application.

The present invention will become more fully understood from the detailed description of this specification. However, the detailed description and the specific embodiment illustrate desired embodiments of the present invention and are described only for the purpose of explanation. Various changes and modifications will be apparent to those of ordinary skills in the art on the basis of the detailed description.

The applicant has no intention to dedicate to the public any disclosed embodiments. Among the disclosed changes and modifications, those that may not literally fall within the scope of the present claims constitute, therefore, a part of the present invention in the sense of the doctrine of equivalents.

The use of the articles "a," "an," and "the," and similar referents in the specification and claims, are to be construed to cover both the singular and the plural, unless otherwise indicated herein or clearly contradicted by the context. The use of any and all examples, or exemplary language (e.g., "such as") provided herein, is intended merely to better illuminate the invention and does not pose a limitation on the scope of the invention unless otherwise claimed.

NAMES OF SYMBOLS

1 pouring ladle
10 holding furnace
20 pouring equipment
30 equipment for control
M mold

The invention claimed is:

1. Pouring equipment comprising:

a holding furnace that stores and holds molten metal and that supplies it by being tilted;

a pouring ladle that stores the molten metal that is supplied from the holding furnace, and that pours the molten metal, by being tilted, into molds that are intermittently transported;

a device for measuring weight, which device measures the weight of the molten metal in the pouring ladle; and equipment for control that controls the tilting movements of the holding furnace and the pouring ladle, wherein the equipment for control comprises;

a device for storing results from measurements, the measurements made by the device for measuring weight;

a device for calculating the first flow rate, which device calculates the flow of the molten metal that is supplied from the holding furnace to the pouring ladle based on the results of the measurements obtained when the molten metal is not poured by the pouring ladle, and which results are stored in the device for storing results from measurements;

a device for calculating the second flow rate, which device calculates the flow of the molten metal that is supplied from the pouring ladle to the mold based on the results of the measurements obtained when the molten metal is poured by the pouring ladle, and which results are stored in the device for storing results from measurements; and a device for storing a flow-pattern, which is a pattern that shows the relationship of the time that the molten metal that is poured from the ladle takes to flow into the mold, which device stores the information on the flow-pattern corresponding to each mold that is transported intermittently, wherein the equipment for control controls the tilting of the pouring ladle so as to have the pouring ladle pour the molten metal into the mold according to the flow pattern specific to each product, based on the information on the flow of the molten metal that is poured into the mold, which information is calculated by and obtained from the device for calculating the second flow rate, and based on the information on the flow pattern corresponding to each mold that is transported intermittently, which information is stored in the a device for storing the flow-pattern.

2. The pouring equipment of claim 1, wherein the device for calculating the second flow rate comprises:

a device for calculating the difference in flow that calculates the difference in flow between the flow of the molten metal that is supplied to the pouring ladle and the flow of the molten metal that is poured from the pouring ladle to the mold, based on the results of measurements when the pouring ladle pours the molten metal; and a device for calculating the flow of the molten metal that calculates the flow of the molten metal that is poured from the pouring ladle to the mold, based on the difference in the flow that is calculated by the device for calculating the difference in flow and the flow of the molten metal that is calculated by the device for calculating the first low rate and that is supplied to the pouring ladle by the holding furnace.

3. The pouring equipment of claim 2, wherein the equipment for control further comprises a device for monitoring the flow of the molten metal that is poured into the mold based on the flow-pattern that is stored in the device for storing the flow-pattern, the flow of the molten metal being calculated by the device for calculating the second flow rate.

4. The pouring equipment of claim 3, wherein the equipment for control comprises:

a device for storing the information on the quantity of the molten metal that is required to be poured for each of the molds that are intermittently transported;

a device for integrating the amount of the molten metal that is poured calculates by accumulation the quantity of the molten metal, based on the flow of the molten metal that is calculated by a device for calculating the flow of the molten metal; and a device for determining the time to stop the pouring by the pouring ladle that determines if the pouring ladle should stop pouring the molten metal, based on the comparison between the quantity of molten metal that is required to be poured and that is stored in the device for storing the information on the quantity of molten metal that is required to be poured and the quantity of the molten metal that is poured and that is calculated in the device for integrating the amount of the molten metal that is poured, wherein the equipment for control has the pouring ladle stop pouring by tilting the pouring ladle, if the device for determining the time to stop the pouring by the pouring ladle determines that it is the time to stop the pouring by the pouring ladle.

5. The pouring equipment of claim 4, wherein the equipment for control comprises a device for monitoring the tilting of the holding furnace that monitors the tilting of the holding furnace, based on the information on the data that were calculated by the device for calculating the first flow rate when the pouring ladle does not pour the molten metal and wherein the device for monitoring the tilting of the holding furnace controls the speed of the tilting of the holding furnace so that the flow that is calculated by the device for calculating the first flow rate is constant when the pouring ladle does not pour the molten metal.

6. The pouring equipment of claim 5, wherein the equipment for control comprises a device for determining the time to stop the pouring by the holding furnace, which device determines whether the holding furnace stops pouring, and wherein the equipment for control tilts the holding furnace so that it stops pouring if the device for determining the time to stop the pouring by the holding furnace determines that the pouring should be stopped.

7. The pouring equipment of claim 6, wherein the device for integrating the amount of the molten metal that is poured further calculates the total molten metal that was poured from the holding furnace into the molds through the pouring ladle and wherein the equipment for control comprises a device for determining the lower limit of the holding furnace, which device determines whether the amount of the molten metal in the holding furnace is less than its lower limit based on the total amount of the molten metal that is poured and that was calculated by the device for integrating the amount of the molten metal that is poured, and wherein the device for determining the time to stop the pouring by the holding furnace determines that the pouring should be stopped if at least the device for determining the lower limit of the holding furnace determines that the amount of the molten metal in the holding furnace is below the lower limit.

8. The pouring equipment of any one of claims 1 to 7, wherein at least two holding furnaces, which are configured to be transported and each of which is configured to supply, by being tilted, the molten metal to the pouring ladle at the position for supplying the molten metal, are used, wherein the pouring equipment further comprises:

a transport line for holding furnace that transports the holding furnaces; and a device for driving the tilting of the holding furnace, which tilts the holding furnace, and which furnace was transported by the transport line for holding furnace to the position for supplying the molten metal, wherein the equipment for control controls the tiltings of the holding furnace and the pouring ladle and also controls the transport of the holding furnace.

9. The pouring equipment of claim 8, wherein if the amount of the molten metal in the holding furnace at the position for supplying the molten metal becomes below its lower limit, the equipment for control has the holding furnace withdrawn to a position of retreat and then has the other holding furnace that is filled with the molten metal transported to the position for supplying the molten metal.

10. The pouring equipment of claim 9, wherein if a type of molten metal is to be changed for another type (a change of materials), the equipment for control has the holding furnace withdrawn to the position of retreat and then has the other holding furnace that is filled with the molten metal of another type transported to the position for supplying the molten metal.

11. The pouring equipment of claim 1, wherein the mold is manufactured by a vertical flaskless molding machine.

12. A method of pouring the molten metal into a mold using pouring equipment, the method comprising:

supplying molten metal by tilting a holding furnace that stores and holds the molten metal;

pouring into molds that are intermittently transported, the molten metal by tilting a pouring ladle that stores the molten metal that is supplied from the holding furnace, measuring, with a device for measuring weight, the weight of the molten metal in the pouring ladle;

controlling, with equipment for control, the tilting movements of the holding furnace and the pouring ladle; and storing, with a device for storing, information on a flow-pattern corresponding to each mold that is transported, intermittently, wherein the flow-pattern is a pattern that shows the relationship of the time that the molten metal that is poured from the ladle takes to flow into the mold, wherein controlling with the equipment for control comprises:

storing, with the device for storing, the measurements made by the device for measuring weights;

calculating, with a device for calculating, the first flow rate, which device calculates the flow of the molten metal that is supplied from the holding furnace to the pouring ladle based on the results of measurements obtained when the molten metal is not poured by the pouring ladle, and which results are stored in the device for storing results from measurements;

calculating, with the device for calculating, the second flow rate, which device calculates the flow of the molten metal that is supplied from the pouring ladle to the mold based on the results of the measurements obtained when the molten metal is poured by the pouring ladle, and which results are stored in the device for storing results from measurements, wherein the equipment for control controls the tilting of the pouring ladle so as to have the pouring ladle pour the molten metal into the mold according to the flow pattern specific to each product, based on the information on the flow of the molten metal that is poured into the mold, which information is calculated by and obtained from the device for calculating the second flow rate, and based on the information on the flow pattern corresponding to each mold that is transported intermittently, which information is stored in the device for storing the flow-pattern.

13. The method of pouring of claim 12, wherein the device for calculating the second flow rate comprises:

a device for calculating the difference in flow that calculates the difference in flow between the flow of the molten metal that is supplied to the pouring ladle and the flow of the molten metal that is poured from the pouring ladle to the mold, based on the results of measurements when the pouring ladle pours the molten metal; and a device for calculating the flow of the molten metal that calculates the flow of the molten metal that is poured from the pouring ladle to the mold, based on the difference in the flow that is calculated by the device for calculating the difference in flow and the flow of the molten metal that is calculated by the device for calculating the first flow rate and that is supplied to the pouring ladle by the holding furnace.

14. The method of pouring of claim 13, wherein the equipment for control further comprises a device for monitoring the flow of the molten metal that is poured into the mold, which flow is calculated by the device for calculating the second flow rate, and which pouring is based on the flow-pattern that is stored in the device for storing the flow-pattern.

15. The method of pouring of claim 14, wherein the equipment for control comprises:

a device for storing the information on the quantity of the molten metal that is required to be poured for each of the molds that are intermittently transported;

a device for integrating the amount of the molten metal that is poured calculates by accumulation the quantity of the molten metal required for the mold, based on the flow of the molten metal that is calculated by a device for calculating the flow of the molten metal; and a device for determining the time to stop the pouring by the pouring ladle that determines if the pouring ladle should stop pouring the molten metal, based on the comparison between the quantity of molten metal that is required to be poured and that is stored in the device for storing the information on the quantity of molten metal that is required to be poured and the quantity of the molten metal that is poured and that is calculated in the device for integrating the amount of the molten metal that is poured, wherein the equipment for control has the pouring ladle stop pouring by tilting the pouring ladle, if the device for determining the time to stop the pouring by the pouring ladle determines that it is the time to stop the pouring by the pouring ladle.

16. The method of pouring of claim 15, wherein the equipment for control comprises a device for monitoring the tilting of the holding furnace that monitors the tilting of the holding furnace, based on the information on the data that were calculated by the device for calculating the first flow rate when the pouring ladle does not pour the molten metal and wherein the device for monitoring the tilting of the holding furnace controls the speed of the tilting of the holding furnace so that the flow that is calculated by the device for calculating the first flow rate is constant when the pouring ladle does not pour the molten metal.

17. The method of pouring of claim 16, wherein the equipment for control comprises a device for determining the time to stop the pouring by the holding furnace, which device determines whether the holding furnace stops pouring, and wherein the equipment for control tilts the holding furnace so that it stops pouring if the device for determining the time to stop the pouring by the holding furnace determines that the pouring should be stopped.

18. The method of pouring of claim 17, wherein the device for integrating the amount of the molten metal that is poured further calculates the total molten metal that was poured from the holding furnace into the molds through the pouring ladle and wherein the equipment for control comprises a device for determining the lower limit of the holding furnace, which device determines whether the amount of the molten metal in the holding furnace is less than its lower limit based on the total amount of the molten metal that is poured and that was calculated by the device for integrating the amount of the molten metal that is poured, and wherein the device for determining the time to stop the pouring by the holding furnace determines that the pouring should be stopped if at least the device for determining the lower limit of the holding furnace determines that the amount of the molten metal in the holding furnace is below the lower limit.

19. The method of pouring of any one of claims 12 to 18, wherein at least two holding furnaces, which are configured to be transported and each of which is configured to supply, by being tilted, the molten metal to the pouring ladle at the position for supplying the molten metal, are used, wherein the pouring equipment further comprises:

a transport line for holding furnace that transports the holding furnaces; and a device for driving the tilting of the holding furnace, which tilts the holding furnace, and which furnace was transported by the transport line for holding furnace to the position for supplying the molten metal, wherein the equipment for control controls the tiltings of the holding furnace and the pouring ladle and also controls the transport of the holding furnace which transport is carried out by the transport line for holding the furnace.

20. The method of pouring of claim 19, wherein if the amount of the molten metal in the holding furnace at the position for supplying the molten metal becomes below its lower limit, the equipment for control has the holding furnace withdrawn to a position of retreat and then has the other holding furnace that is filled with the molten metal transported to the position for supplying the molten metal.

21. The method of pouring of claim 20, wherein if the type of molten metal is to be changed for another type (a change of materials), the equipment for control has the holding furnace withdrawn to the position of retreat and then has the holding furnace that is filled with the molten metal of another type transported to the position for supplying the molten metal.

22. The method of pouring of claim 12, wherein the mold is manufactured by a vertical flaskless molding machine.

* * * * *